US008378732B2

(12) United States Patent
Kousai et al.

(10) Patent No.: US 8,378,732 B2
(45) Date of Patent: Feb. 19, 2013

(54) OCTAVE-RANGE, WATT-LEVEL, FULLY-INTEGRATED CMOS SWITCHING POWER MIXER ARRAY FOR LINEARIZATION AND BACK-OFF-EFFICIENCY IMPROVEMENT

(75) Inventors: Shouhei Kousai, Kawasaki (JP); Seyed Ali Hajimiri, Pasadena, CA (US)

(73) Assignee: California Institute of Technology, Pasadena, CA (US)

( * ) Notice: Subject to any disclaimer, the term of this patent is extended or adjusted under 35 U.S.C. 154(b) by 0 days.

(21) Appl. No.: 12/586,471

(22) Filed: Sep. 22, 2009

(65) Prior Publication Data

US 2010/0090745 A1 Apr. 15, 2010

Related U.S. Application Data

(60) Provisional application No. 61/205,088, filed on Jan. 15, 2009, provisional application No. 61/192,792, filed on Sep. 22, 2008.

(51) Int. Cl.
*G06G 7/16* (2006.01)

(52) U.S. Cl. ..... 327/355; 327/360; 455/323

(58) Field of Classification Search ..... 327/355–361; 455/326, 333, 323
See application file for complete search history.

(56) References Cited

U.S. PATENT DOCUMENTS

| | | | | |
|---|---|---|---|---|
| 5,483,696 | A * | 1/1996 | Wheatley et al. | 455/318 |
| 6,118,810 | A * | 9/2000 | Wynn | 375/219 |
| 6,147,543 | A * | 11/2000 | Gailus et al. | 327/355 |
| 6,259,301 | B1 * | 7/2001 | Gailus et al. | 327/355 |
| 6,314,330 | B1 * | 11/2001 | Matthews | 700/94 |
| 6,627,992 | B2 * | 9/2003 | Ammar | 257/728 |
| 6,720,919 | B1 * | 4/2004 | Sinsky et al. | 342/368 |
| 7,411,930 | B2 * | 8/2008 | Montojo et al. | 370/335 |
| 7,733,980 | B2 * | 6/2010 | Beukema et al. | 375/300 |

* cited by examiner

*Primary Examiner* — Dinh T. Le
(74) *Attorney, Agent, or Firm* — Milstein Zhang & Wu LLC; Joseph B. Milstein

(57) ABSTRACT

Power mixer arrays for providing watt-level power in mobile systems. In one embodiment, a fully-integrated octave-range CMOS power mixer that occupies only 2.6 mm$^2$ using a 130 nm semiconductor process has been demonstrated. The power mixer provides an output power of +31.5 dBm into an external 50 Ω load with a power added efficiency (PAE) of 44% at 1.8 GHz and a full power gain compression of only 0.4 dB.

12 Claims, 29 Drawing Sheets

| | | |
|---|---|---|
| Frequency | | 1.8 GHz |
| Maximum Output Power | | 31.5 dBm |
| Peak PAE | | 42 % |
| LO Input Power | | 3 dBm |
| Die Area | | 2.56 $mm^2$ |
| Maximum LO to RF Power Gain | | 28.5 dB |
| BB to RF Voltage Conversion Gain | | 20.4 dB |
| OP1dB | BA-mode | 28.4 dBm |
| | LA-mode | 31.5 dBm |
| | Supply Voltage | Power Consumption |
| Power Mixer Array | 3 V | 2.94 W |
| LO Digital Distributor | 1.2 V | 0.27 W |
| Analog BB Replica Linearizer | 3 V | 18 mW |
| Analog BB Distributor | 3 V | < 0.1 mW |
| Digital Controller | 1.2 V | < 0.1 mW |

FIG. 12

OCTAVE-RANGE, WATT-LEVEL, FULLY-INTEGRATED CMOS SWITCHING POWER MIXER ARRAY FOR LINEARIZATION AND BACK-OFF-EFFICIENCY IMPROVEMENT

CROSS-REFERENCE TO RELATED APPLICATIONS

This application claims priority to and the benefit of co-pending U.S. provisional patent application Ser. No. 61/192,792, filed Sep. 22, 2008, and this application claims priority to and the benefit of co-pending U.S. provisional patent application Ser. No. 61/205,088, filed Jan. 15, 2009, each of which applications is incorporated herein by reference in its entirety.

BACKGROUND OF THE INVENTION

1. Field of the Invention

The invention relates to power amplifiers in general and particularly to a power mixer array that employs a plurality of power generation elements.

2. Description of Related Art

Non-constant envelope modulation schemes have become more commonplace in cellular applications due to their higher spectral efficiency. Linear power amplifiers (Pas) are usually used to transmit these signals faithfully at the expense of the power efficiency. Separate processing of amplitude and phase information (e.g., EER or polar modulation) has been proposed as way of improving the system efficiency. See L. Kahn, "Single-sided transmission by envelope elimination and restoration," *Proc. IRE*, pp. 803-806, July 1952. However, many of these schemes require an efficient high-power low-frequency supply modulator to reconstruct the amplitude information. This can be done, for instance, using a DC-to-DC converter with its own limitations in efficiency, bandwidth, and chip area (because of the requirement for an external inductor).

Even for an ideal supply modulator, the amplitude dynamic range of the power amplifier itself is limited by the gate to drain feed-through. For example, as described in S. Hietakangas, et al., "Feedthrough cancellation in a class E amplified polar transmitter", *European Conference on Circuit Theory and Design*, pp. 591-594, August 2007, a 10 dB change in the supply results in 5° phase shift at the output. Although digitally modulated polar power amplifiers described by A. Kavousian, et al., in "A Digitally Modulated Polar CMOS PA with 20 MHz Signal BW", *ISSCC Dig. Tech. Papers*, pp. 78-79, February 2007 has been shown as a possible solution at lower power levels, its implementation in a wideband watt-level fully-integrated setting with low spurious and out-of-band emission faces practical challenges such as number of required bits and layout symmetry.

As shown in FIG. 1, various approaches that have been tried suffer from different deficiencies. For example, class A amplifier and class AB amplifier implementations are faithful, traditional implementations. However, the peak efficiency is not good, and the efficiency drops abruptly with decreased output power. In the Doherty implementation, matching is difficult, and there are issues relating to area. In DC-DC implementations, there are issues relating to area, the need for external inductance, overall efficiency, and back-off efficiency. In some digital implementations, the use of high resolution RF-digital-to-analog converters (DAC) generally leads to a larger area resulting from inefficient layout, and it becomes extremely difficult to realize the same impedance seen by each amplifier. Digital implementations have not demonstrated watt-level power amplification. In sigma-delta implementations, one experiences out of band noise.

There is a need for a wideband watt-level power amplifier that provides good linearity and high efficiency.

SUMMARY OF THE INVENTION

In one aspect, the invention relates to a monolithic power mixer array. The monolithic power mixer array comprises a substrate having a surface; a plurality of power generation units adjacent the surface, each power generation unit having at least one signal input terminal, at least one baseband input terminal, and a signal output terminal; a power combiner adjacent the surface, the power combiner having a plurality of input terminals sufficient in number to accept a power signal from each of the plurality of power generation unit signal output terminals and having an output terminal; and a digital controller adjacent the surface, the digital controller configured to control the operation of each of the plurality of power generation units, and configured to control an input signal to the at least one signal input terminal of each of the plurality of power generation units. The monolithic power mixer array is configured to provide a power signal having a power level measured in units of watts.

In one embodiment, the monolithic power mixer array further comprises a baseband analog replica linearizer array adjacent the surface, the baseband analog replica linearizer array configured to receive an input baseband envelope signal and to generate at least one component signal configured as an input signal for at least one of the plurality of power generation units.

In one embodiment, the monolithic power mixer array further comprises a baseband analog distributor adjacent the surface, the baseband analog distributor configured to receive at least one component signal configured as an input signal for at least one of the plurality of power generation units from the baseband analog replica linearizer array and configured to provide the component signal as an input signal to at least one of the plurality of power generation units.

In one embodiment, the digital controller configured to control the operation of each of the plurality of power generation units controls a local oscillator digital distributor configured to provide a local oscillator signal to each of the plurality of power generation units. In one embodiment, the local oscillator digital distributor provides the same local oscillator signal to each of the plurality of power generation units.

In one embodiment, the monolithic power mixer array further comprises an output transformer. In one embodiment, the output transformer is configured to comprise a differential to single ended connection.

In one embodiment, the plurality of power generation units are operated according to a $2^N$-QAM modulation constellation. In one embodiment, the digital controller is configured to operate less than all of the plurality of power generation units in response to a $2^N$-QAM symbol representative of a power level lower that the maximum power level of the power mixer array.

In one embodiment, the plurality of power generation units are operated according to a $\pi/4$-OQPSK modulation constellation.

In one embodiment, the digital controller is configured to operate the monolithic power mixer in a Segmented-Linear (SL) mode. In one embodiment, the digital controller is configured to operate the monolithic power mixer in a Segmented-Efficiency (SE) mode. In one embodiment, the digital controller is configured to operate the monolithic power mixer in a Linearized Analog (LA) mode.

The foregoing and other objects, aspects, features, and advantages of the invention will become more apparent from the following description and from the claims.

BRIEF DESCRIPTION OF THE DRAWINGS

The objects and features of the invention can be better understood with reference to the drawings described below, and the claims. The drawings are not necessarily to scale, emphasis instead generally being placed upon illustrating the principles of the invention. In the drawings, like numerals are used to indicate like parts throughout the various views.

FIG. 12 is a table that summarizes the performance of the prototype device.

DETAILED DESCRIPTION OF THE INVENTION

Figure 1:
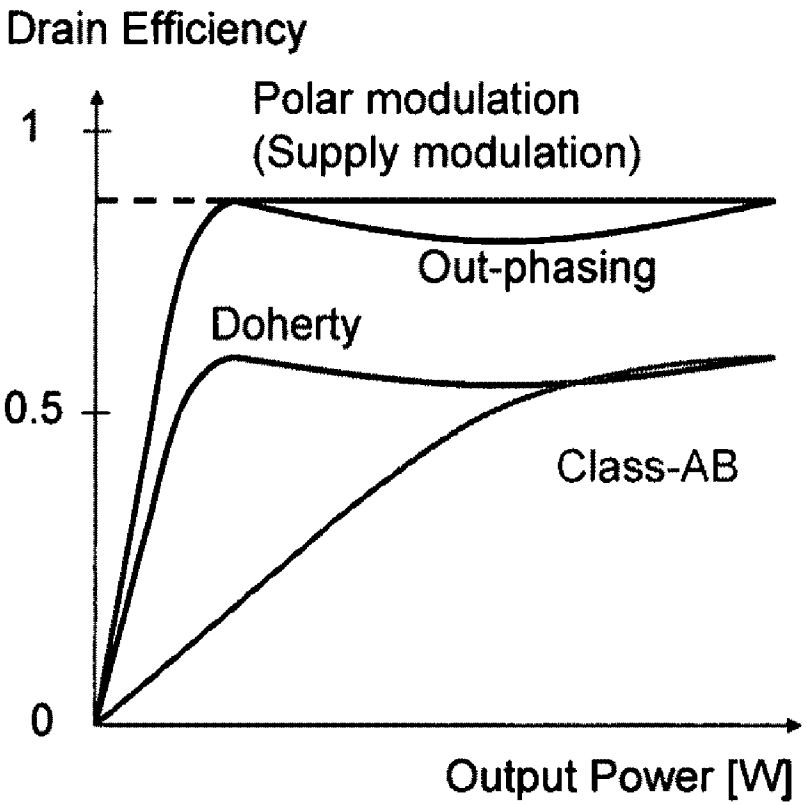
FIG. 1 is a diagram illustrating some of the limitations of other possible implementations for power amplification.
Figure 2:
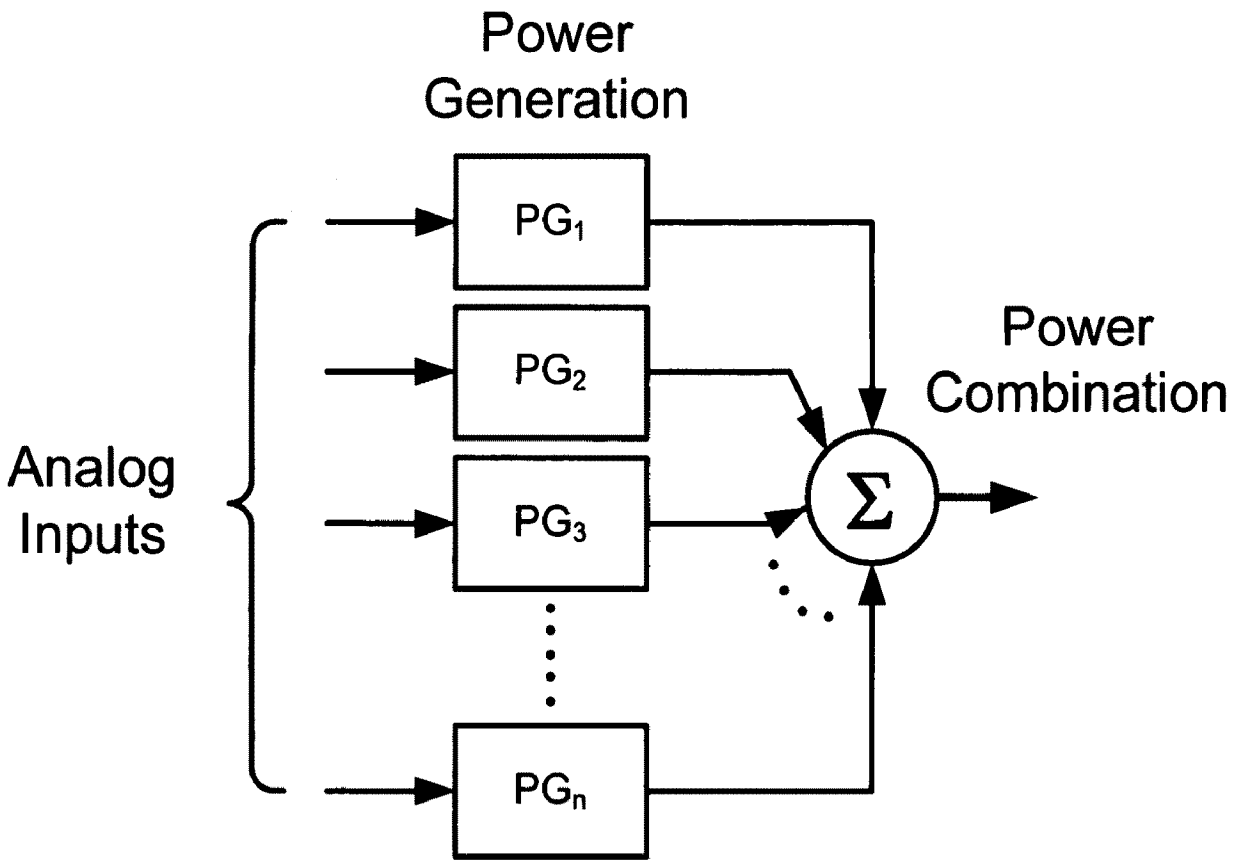
FIG. 2 is a diagram that shows in general form an approach to solving the power amplification problem.
Figure 3:
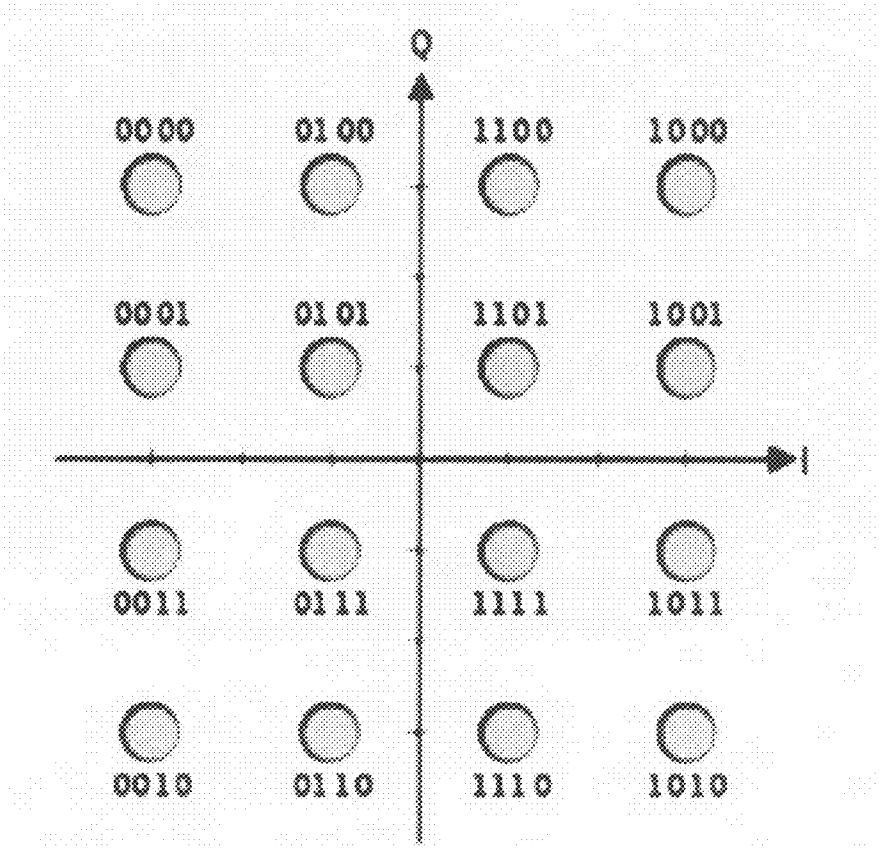
FIG. 3 PRIOR ART
FIG. 3 is a diagram illustrating a 16-QAM modulation constellation.

For some applications, such as mobile communication systems, it is important to provide the power efficient generation of spectrum efficient non-constant envelope signals. A power mixer array is an effective means for providing power while maintaining linearization and achieving back-off-efficiency improvement. As shown in FIG. 2, one can provide an array of power generation elements, each driven by a separate signal, such as an analog signal, and a power combination stage that receives the output from each power generator element and provides an output power signal. As necessary, the analog input signal can be digitized. In different embodiments, the input signals can be represented by either analog or digital Quadrature Amplitude Modulation (QAM) symbols. FIG. 3 is a diagram illustrating a 16-QAM modulation constellation. In other embodiments, one can use a $2^N$-QAM modulation constellation, where N is a positive integer.

For a system having N power generation elements, at low power requirement, for example represented by the symbol 0101 of the 16-QAM constellation of FIG. 3, one can turn on or operate only a small number of power generation elements, each of which can be operated near its maximum power. At high power requirement, for example illustrated by the symbol 0000 of the 16-QAM constellation of FIG. 3, one can turn on or operate a large number (or all) of the power generation elements, each of which operates at near its maximum power.

Figure 4:
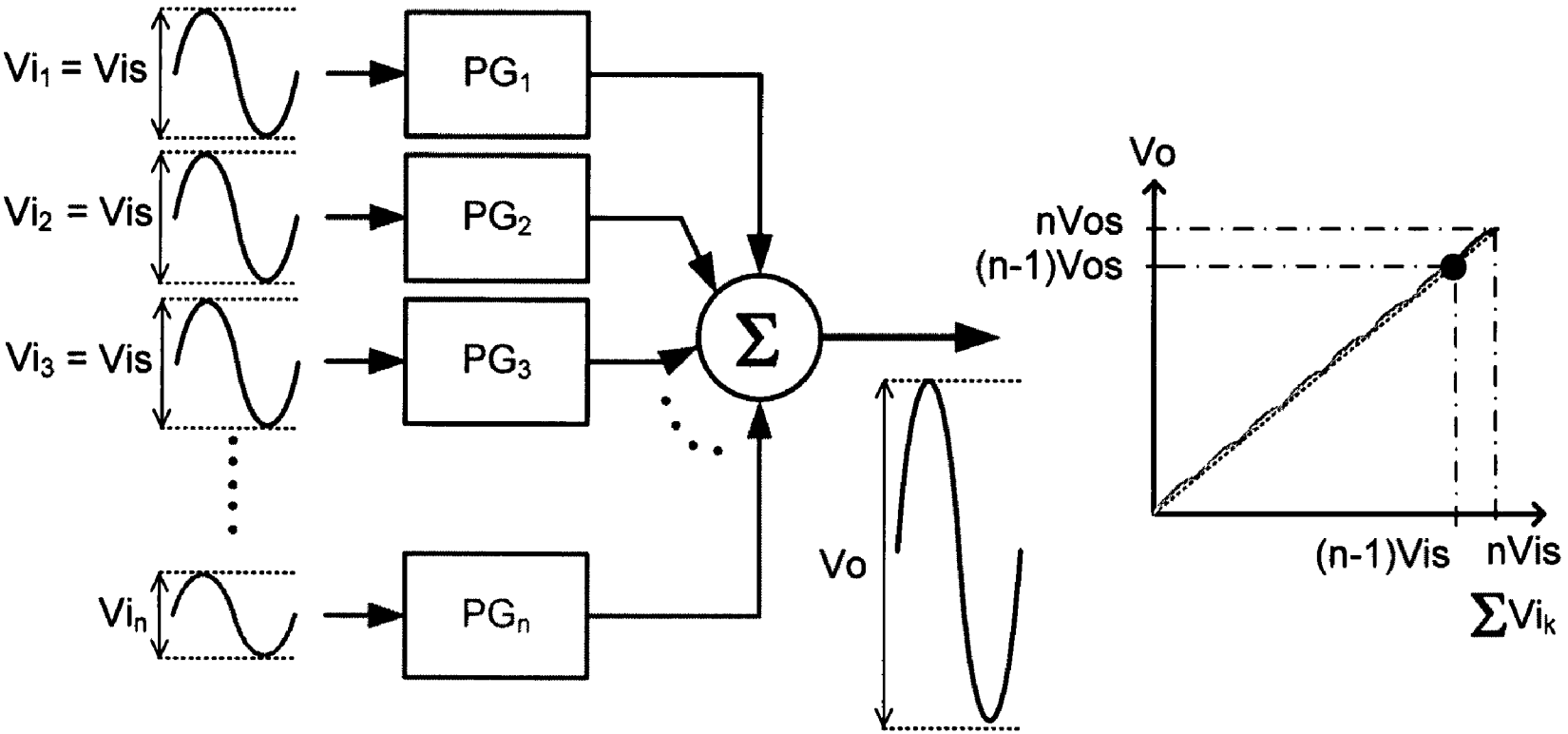
FIG. 4 illustrates the linearity of the power output as a function of power.

FIG. 4 illustrates the linearity of the power output as a function of power. Linearity improves as the power output increases We present a fully-integrated octave-range CMOS power mixer that occupies only 2.6 $mm^2$ using a 130 nm semiconductor process. The power mixer provides an output power of +31.5 dBm into an external 50 Ω load with a power added efficiency (PAE) of 44% at 1.8 GHz and a full power gain compression of only 0.4 dB.

Figure 5:
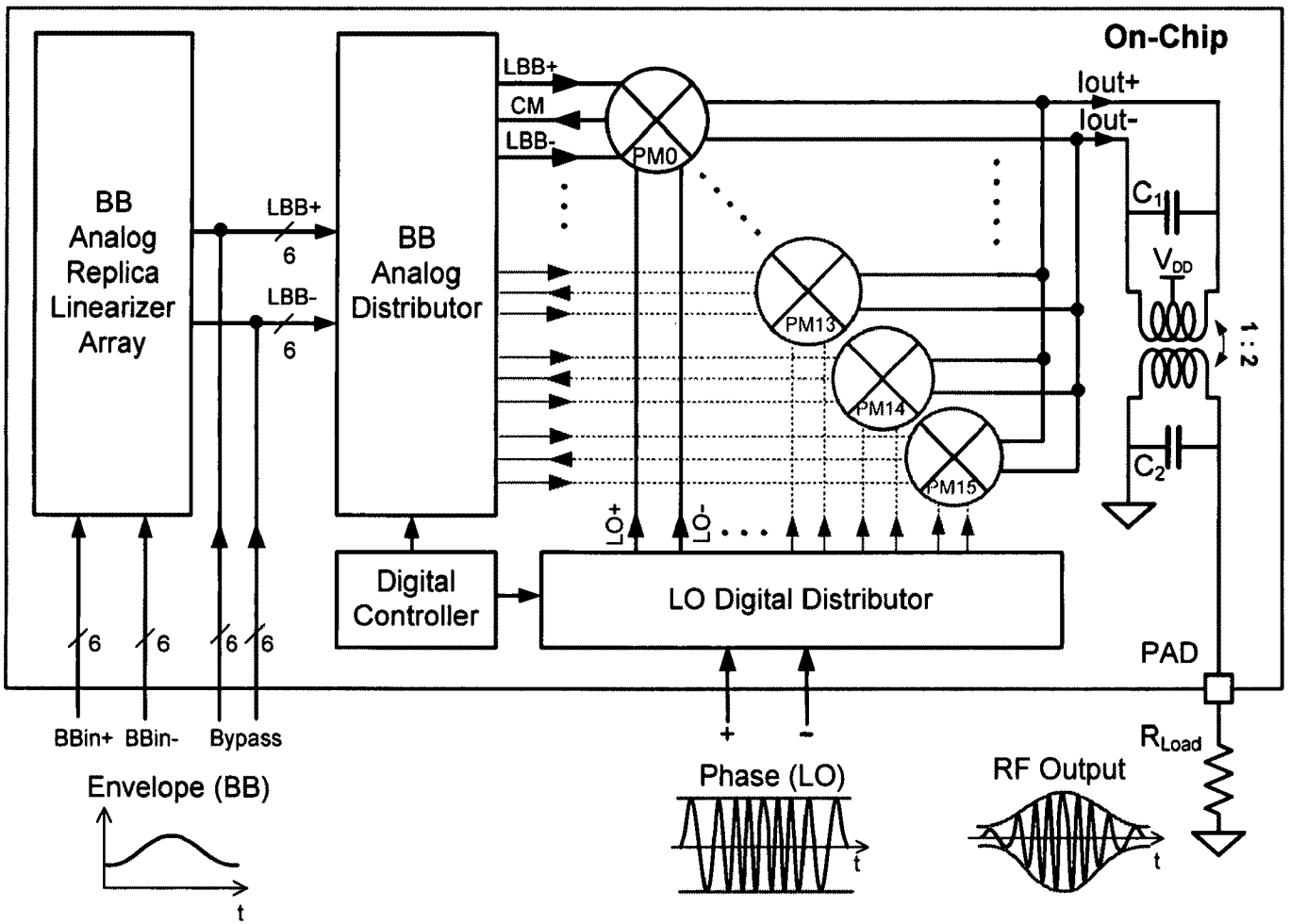
FIG. 5 is a block diagram of an illustrative polar modulation system, according to principles of the invention.

The power mixer array, shown in FIG. 5, overcomes the problems alluded to above by selectively applying AC current to a sufficient number of individually-linearized power mixers (shown in FIG. 6) to generate the necessary output power while maintaining linearity and back-off efficiency. The system requires less area. It provides RF power generation, amplification and modulation. Identical LO signals are applied to each mixer. The switching Mixer has high efficiency. Small, power efficient inverters are sufficient for the LO driver amplifiers. The inputs are at baseband frequency. The input signals are pulse shaped to avoid spurious signal and alias problems.

A current-commuting mixer has a high power efficiency, since the lower-tree common-source transistors (M1 and M2) are driven by the LO switch between triode and cut-off modes. The power mixer utilizes a double cascode topology with a thick gate oxide top-transistors (M7 and M8) to increase the maximum drain voltage swings without long term stress induced degradation. The baseband (BB) signals are applied to the middle-tree differential pairs (M3, M4, M5 and M6), rendering a separate supply modulator (e.g., a DC-DC converter) unnecessary. As a result the illustrative system can have small die area, high efficiency and large signal bandwidth.

In this implementation, the output currents of sixteen power mixer cores are combined at their drains, where the non-constant envelope RF signal is restored (FIG. 5). The resultant non-constant envelope current is impedance transformed to drive the external 50 Ω load using a tuned on-chip transformer that does not degrade the linearity. The phase-modulated local oscillator (LO) signal is buffered and selectively applied to the desired number of power mixer cores by the digital LO distributor. The choice of how many and which power mixers receive the digital LO are controlled by an on-chip digital controller. The differential baseband (BB) envelope signal is linearized by BB analog replica linearizers (FIG. 6) and then applied to the power mixer cores via a BB analog distributor. The BB analog distributor can connect each unit power mixer core to any of the differentially linearized BB (LBB) signals while it feeds back the mixer's common-mode (CM) information to the analog replica linearizers.

Figure 6:
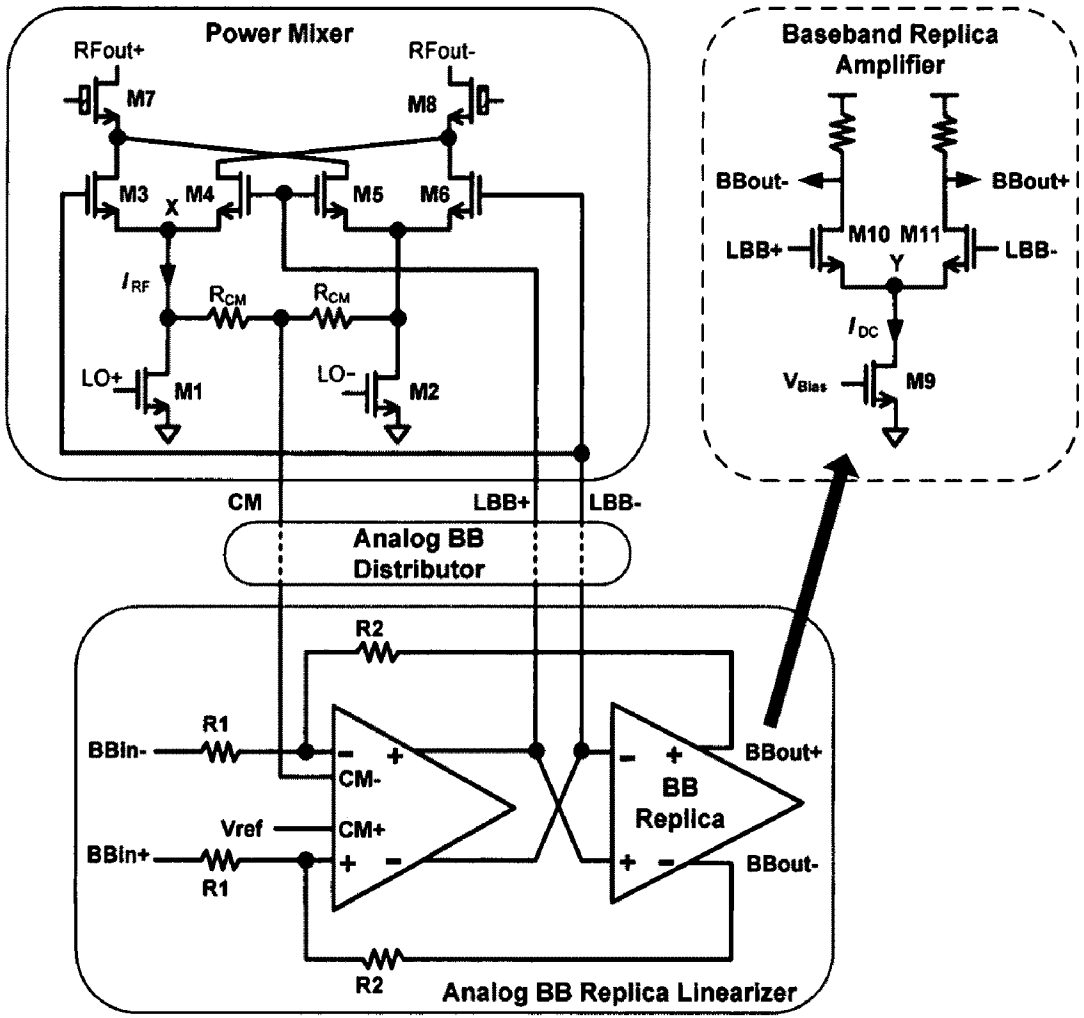
FIG. 6 is a schematic diagram of an illustrative of a power mixer core and an analog baseband (BB) replica linearizer, according to principles of the invention.

FIG. 6 shows the schematic of a power mixer core connected to one of the BB analog replica linearizers that generate the differential linearized BB (LBB) signal. A replica differential pair is used to model the nonlinearity of the voltage-to-current conversion of the power mixer core. The BB replica is placed inside a resistive feedback loop with another amplifier. The feedback linearizes the transfer function from the BBin inputs to the BBout outputs and in the process generates a differential signal LBB at the input of the replica, which produces an output signal linear to the BBin signal. This LBB differential signal is then applied to the gates of the middle-tree power mixer cores, as shown in FIG. 6. To accurately compensate the nonlinearity of the power mixer core, one needs to account for the switching nature of the common-source transistors (M1 and M2) driven by the LO. In the switching mode, the drain RF current of these transistors, $I_{RF}$, is proportional to the DC voltage of node X to the first order. An additional common-mode (CM) feedback mechanism is used to match the voltage of node X to its replica equivalent voltage at node Y dynamically to maintain linearity. We refer to this as the Analog-Linearized (AL) mode.

Figures 7A, 7B, 7C, 7D:
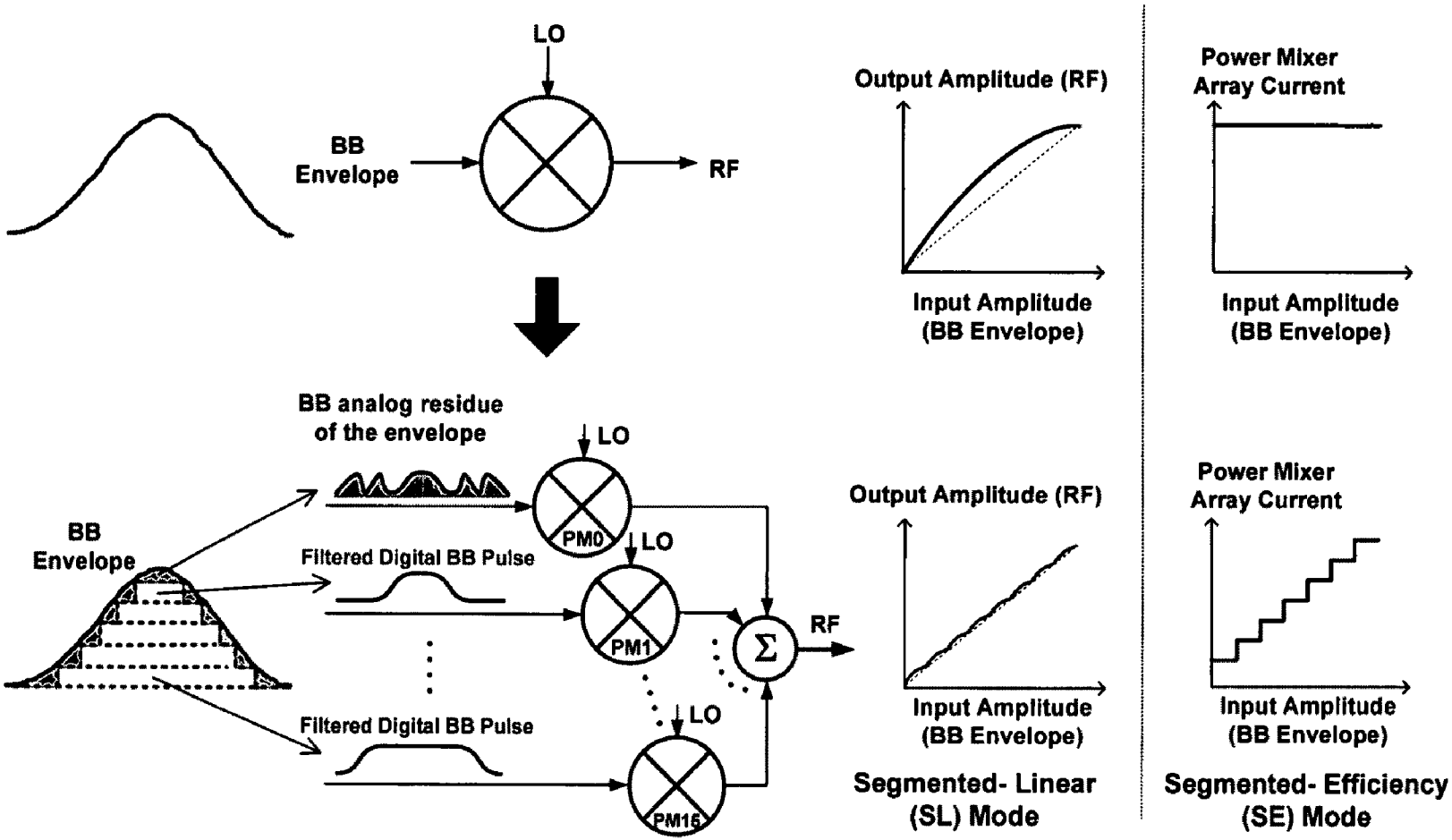
FIG. 7 is a schematic diagram illustrating how one can achieve a Segmented-Linear (SL) mode and a Segmented-Efficiency (SE) mode, according to principles of the invention.

FIG. 7A shows a diagram of an input represented by a baseband envelope applied to a single power mixer. FIG. 7B shows the output RF amplitude and the power mixer array current as a function of input amplitude of the baseband envelope. As one sees, the output amplitude is nonlinear and the current is high even for low output amplitude.

FIG. 7C shows a diagram of a power mixer array, having a plurality of inputs. The linearization can also be achieved using the Segmented-Linearized (SL) mode as shown in FIG. 7D. In the SL-mode the BB input of all but one (n-1) of the power mixers cores can be either at zero or at maximum levels to represent an (n-1)-level thermometer code. The transition between these discrete BB levels can be pulsed shaped appropriately to minimize the in- and out-of-band aliasing and spurious generation. The remaining power mixer core can be used to capture the analog residue, if necessary. Note that in the SL-mode, to avoid linearity degradation due to output impedance variations (both resistive and capacitive parts), the LO signal is applied to all of the power mixer cores. This maintains similar output impedances for different power levels.

In the case of a non-constant envelope modulation, the number of power mixer cores that receive the LO signal for a given symbol can be dynamically adjusted to improve the overall efficiency for the symbols that do not need the full power. This can also be used on slower time scales to improve the back-off efficiency. We refer to this dynamic activation of different power mixer cores as the Segmented-Efficiency (SE) mode, also shown in FIG. 7D.

Figure 8:
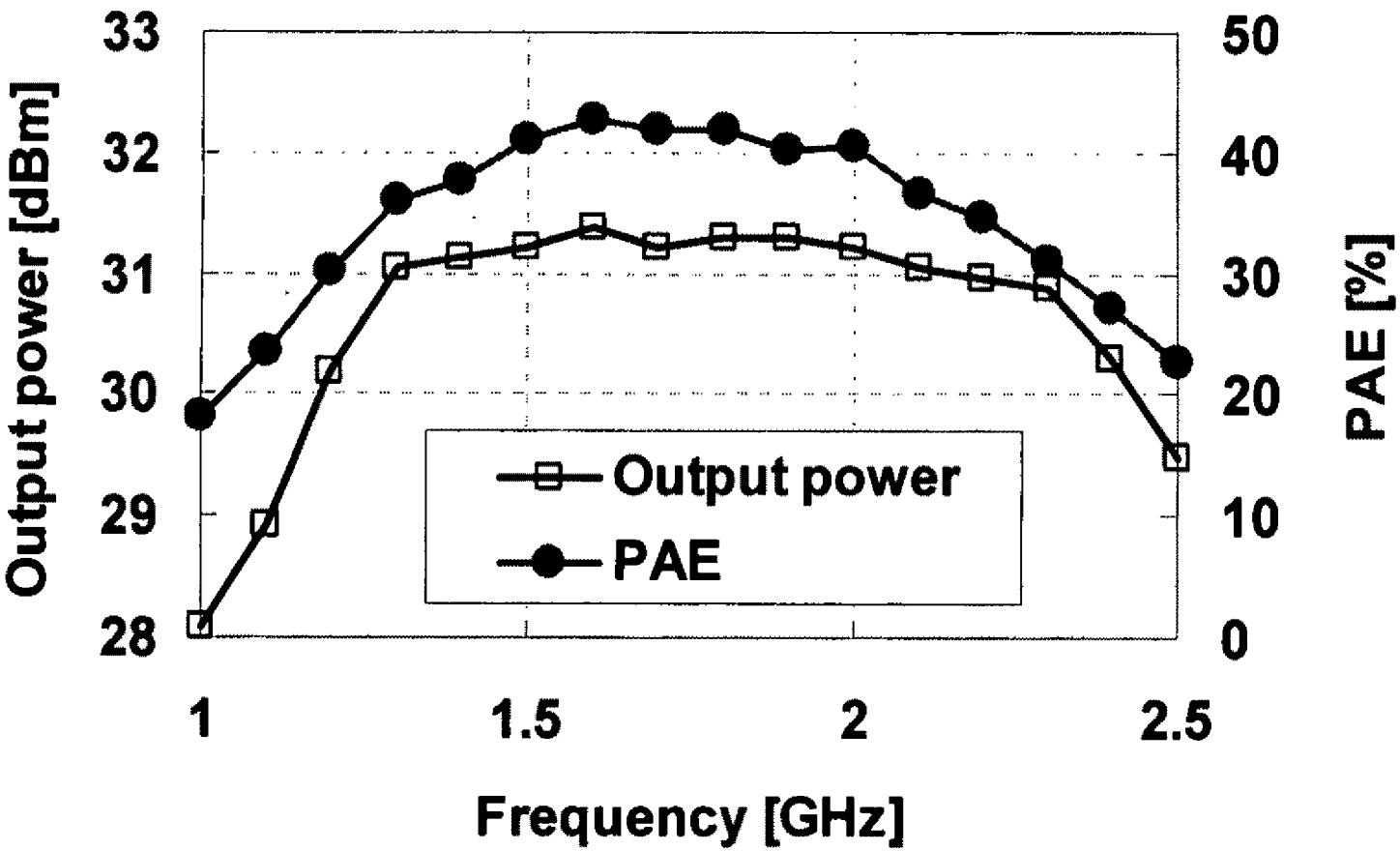
FIG. 8 is a graph of the measured frequency dependence of maximum output power and peak power added efficiency (PAE).

A prototype was fabricated in a standard 130 nm CMOS process. FIG. 8 shows the measured maximum output power and PAE of the power mixer array. The PAE is greater than 40% between 1.6 GHz and 2 GHz with a peak of 45% at 1.6 GHz, and the output power is greater than 1 W over an octave from 1.2 GHz to 2.4 GHz. The power mixer has an LO-to-RF power gain of +28.5 dB. It produces the maximum output power of +31.5 dBm with a BB input voltage swing of 450 mV.

Figure 9B:
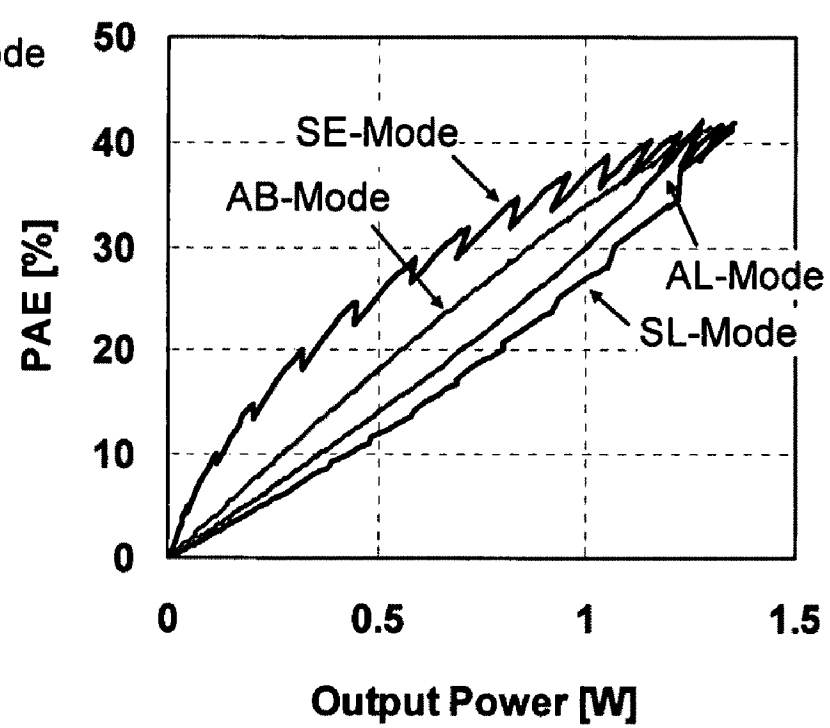
FIG. 9B is a graph showing the measured output power dependence of PAE as a function of output power.
Figure 9A:
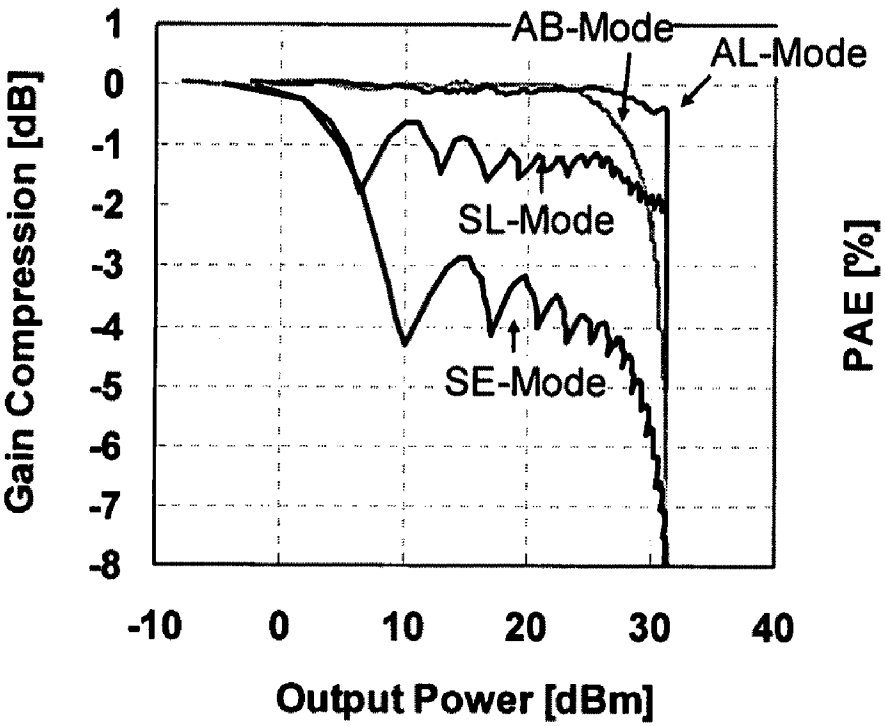
FIG. 9A is a graph showing the measured output power dependence of conversion gain as a function of output power.

FIG. 9 shows the measured PAE and conversion gain dependence on the output power at 1.8 GHz for four different operation modes. We have measured the performances for four different operation modes. We have included the Analog-Baseline (AB) mode, in which the analog replica linearizers are bypassed and the BB signal is directly applied to all the mixers. The output 1 dB compression point (OP1dB) in the AB-mode power mixer is +28.4 dBm with none of the linearization modes active. In the Analog-Linearized (AL) mode the OP1dB is simply +31.5 dBm since the gain compression is less than 0.4 dB even for the maximum output power of +31.5 dBm. As for Segmented-Linearized (SL) mode, the gain variation for the output power levels greater than +20 dBm is within 0.9 dB. The Segmented-Efficiency (SE) mode clearly demonstrates an improved efficiency at lower power levels, albeit at the expense of lower OP1dB due to the variation of the output impedance with the number of active stages, as expected. In practice, the linearity can be further improved by applying conventional baseband techniques, such as overlapping.

Figure 10B:
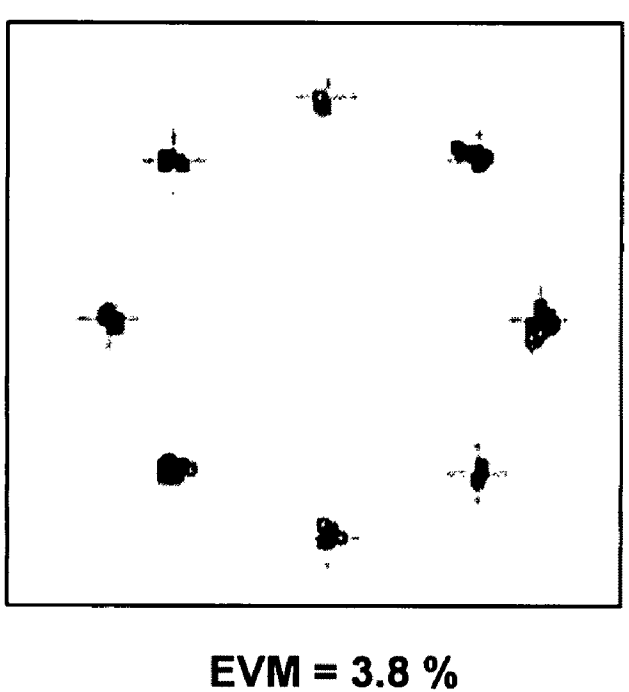
FIG. 10B is a diagram that shows a measured constellation of π/4-OQPSK modulated signal.
Figure 10A:
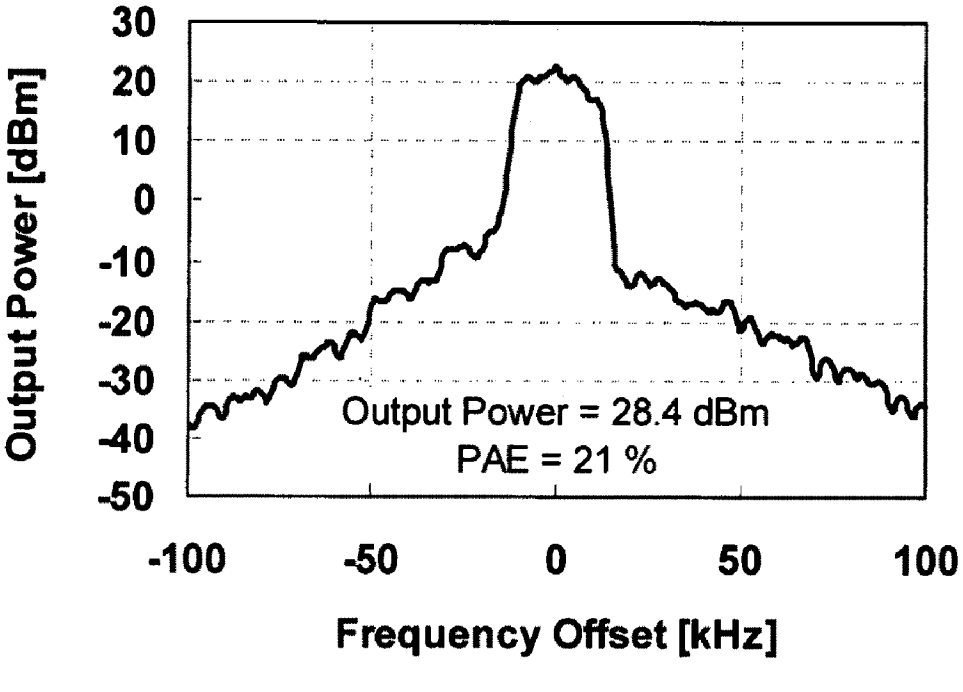
FIG. 10A is a diagram that shows a measured power spectrum of a π/4-OQPSK modulated signal as a function of frequency offset.

To demonstrate the validity of our proposed power mixer array, the spectrum and constellation of a π/4-OQPSK modulated signal with 20 ksym/s at 1.8 GHz is measured in the AL-mode, as shown in FIG. 10. The measured error vector magnitude (EVM) is less than 4% with an output power of +28.4 dBm and an overall PAE of 21%. In SL-mode, the AM-modulated RF output is measured at 1.8 GHz with cores activated in units of 4. The output power and PAE are +27.6 dBm and 19% respectively, using a modulation index of 0.5 with 500 kHz sine-wave.

Figure 11:
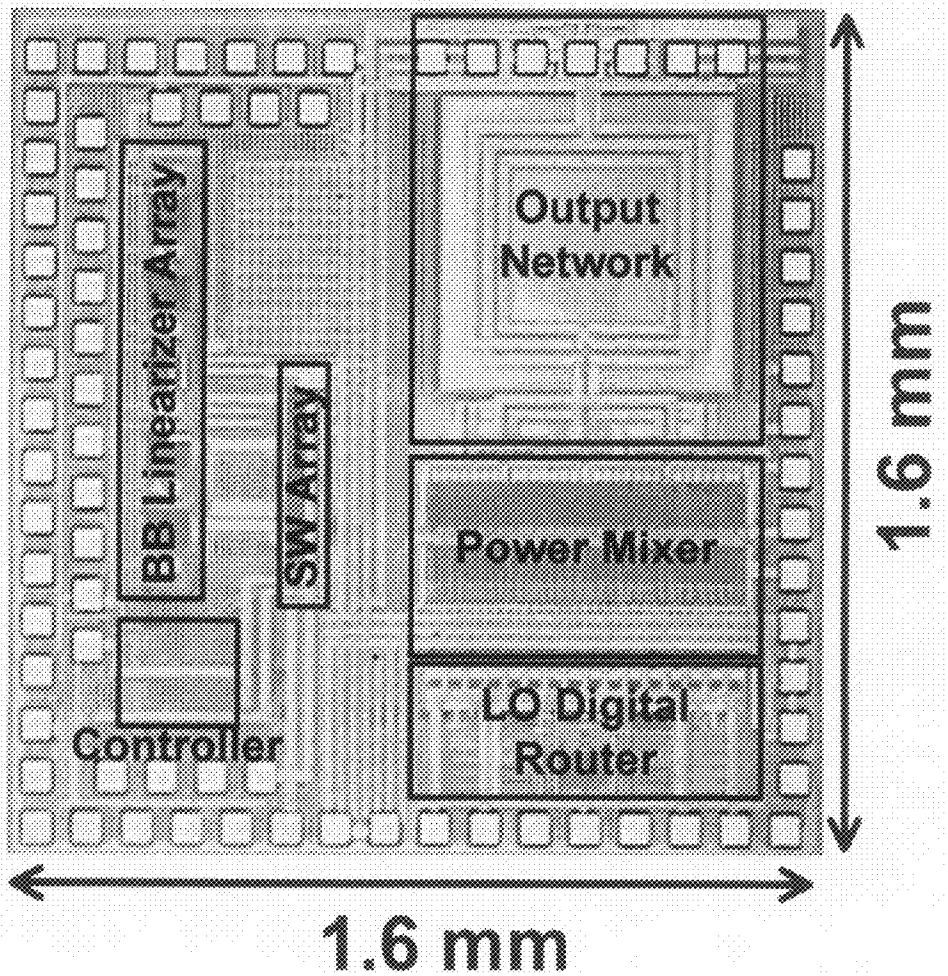
FIG. 11 shows the die layout of the prototype.

FIG. 11 shows the die layout of the prototype. The circuits are fabricated in a 130 nm CMOS technology. The entire chip occupies an area of 1.6 mm by 1.6 mm.

FIG. 12 is a table that summarizes some of the features of the prototype system and the measured operational characteristics that it exhibits.

We now turn to a more detailed discussion of the invention.

Figure 13:
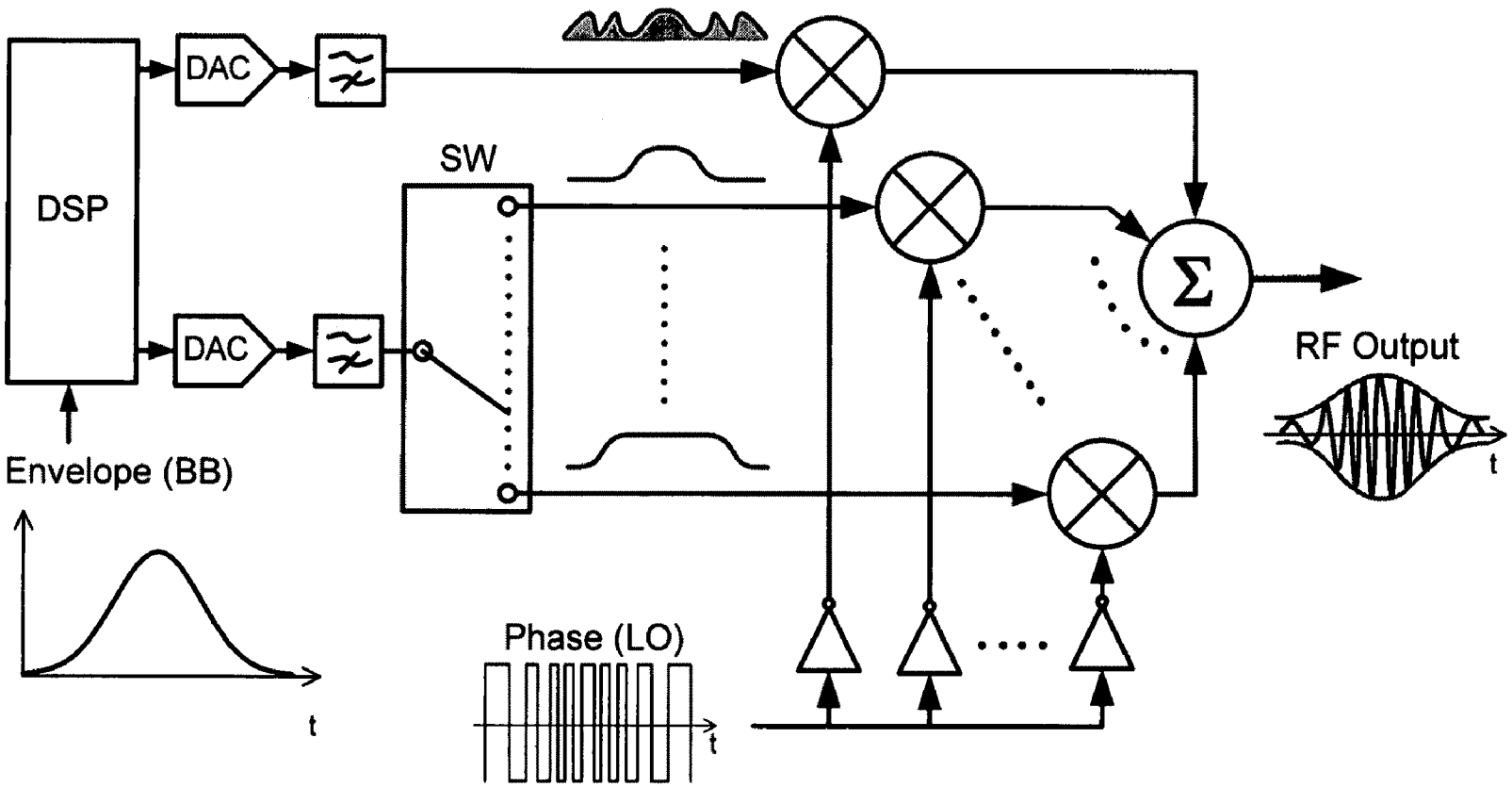
FIG. 13 is a schematic diagram that illustrates how the power mixer array utilizes baseband circuit sharing.

FIG. 13 is a schematic diagram that illustrates how the power mixer array utilizes baseband circuit sharing. Using this approach, one can match the delay inputs because the input is at the baseband frequency.

Figure 14:
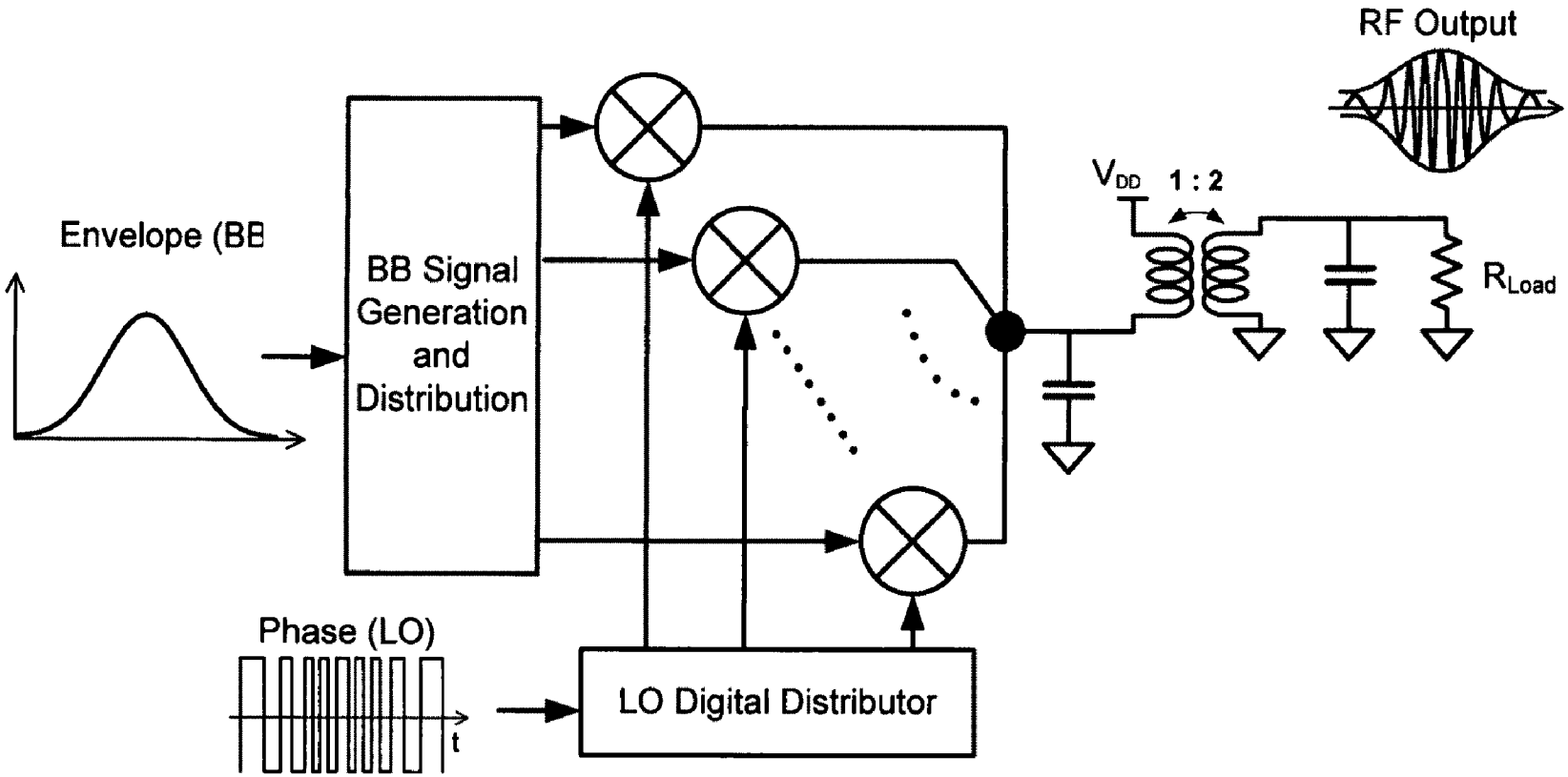
FIG. 14 is a schematic diagram that illustrates how the output signals can be combined in the current domain.

FIG. 14 is a schematic diagram that illustrates how the output signals can be combined in the current domain. A transformer is a suitable device for a large impedance transformation ratio for the watt-level power amplifiers. One can obtain a 1:2 ratio using a differential to single ended connection, and one can obtain a 1:4 ration using suitable impedances, yielding a total of 1:8 impedance transform.

Figure 15:
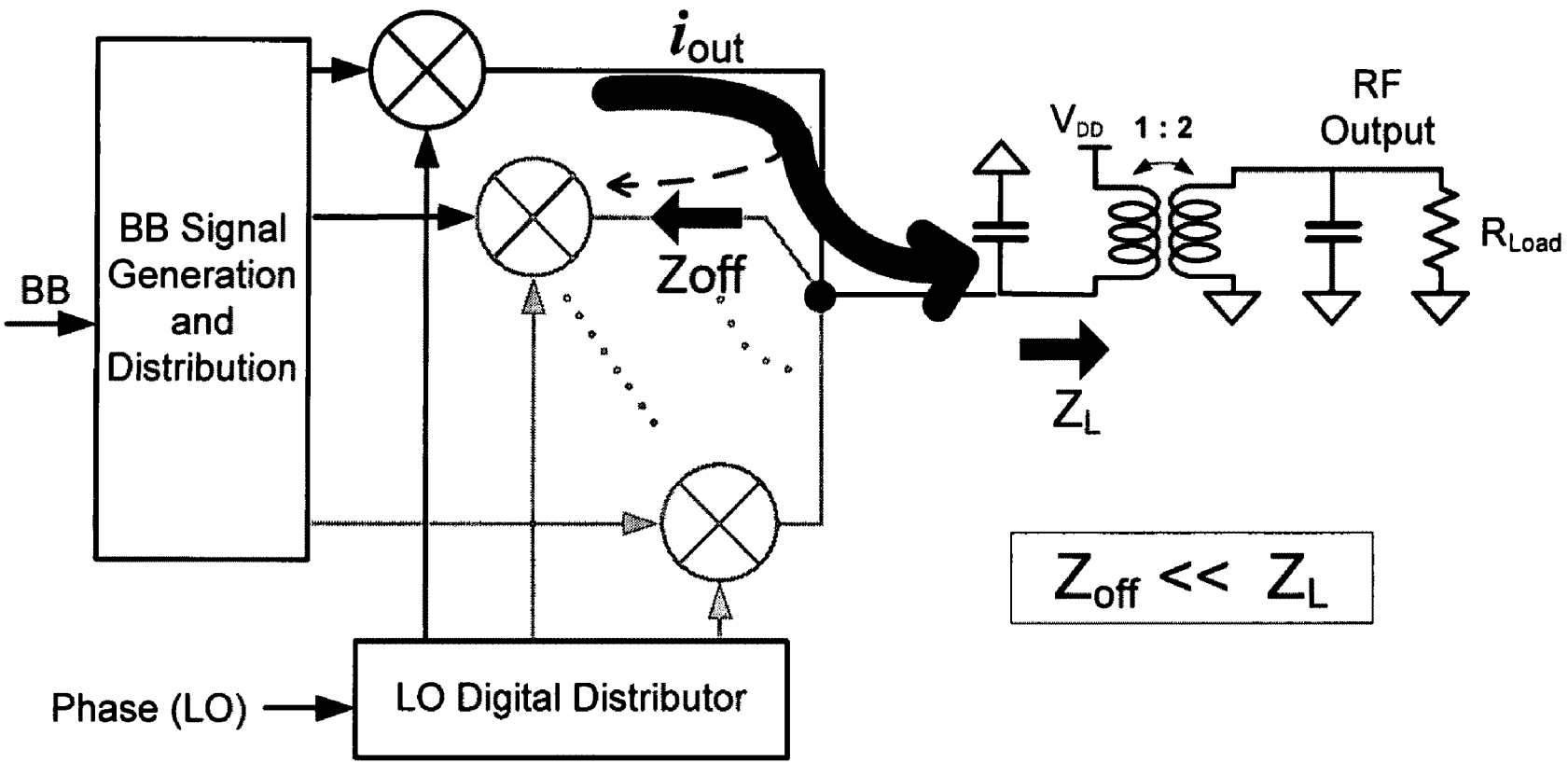
FIG. 15, FIG. 16 and FIG. 17 illustrate the output impedance of the power mixer, and the current flows that result, under varying conditions.
Figure 16:
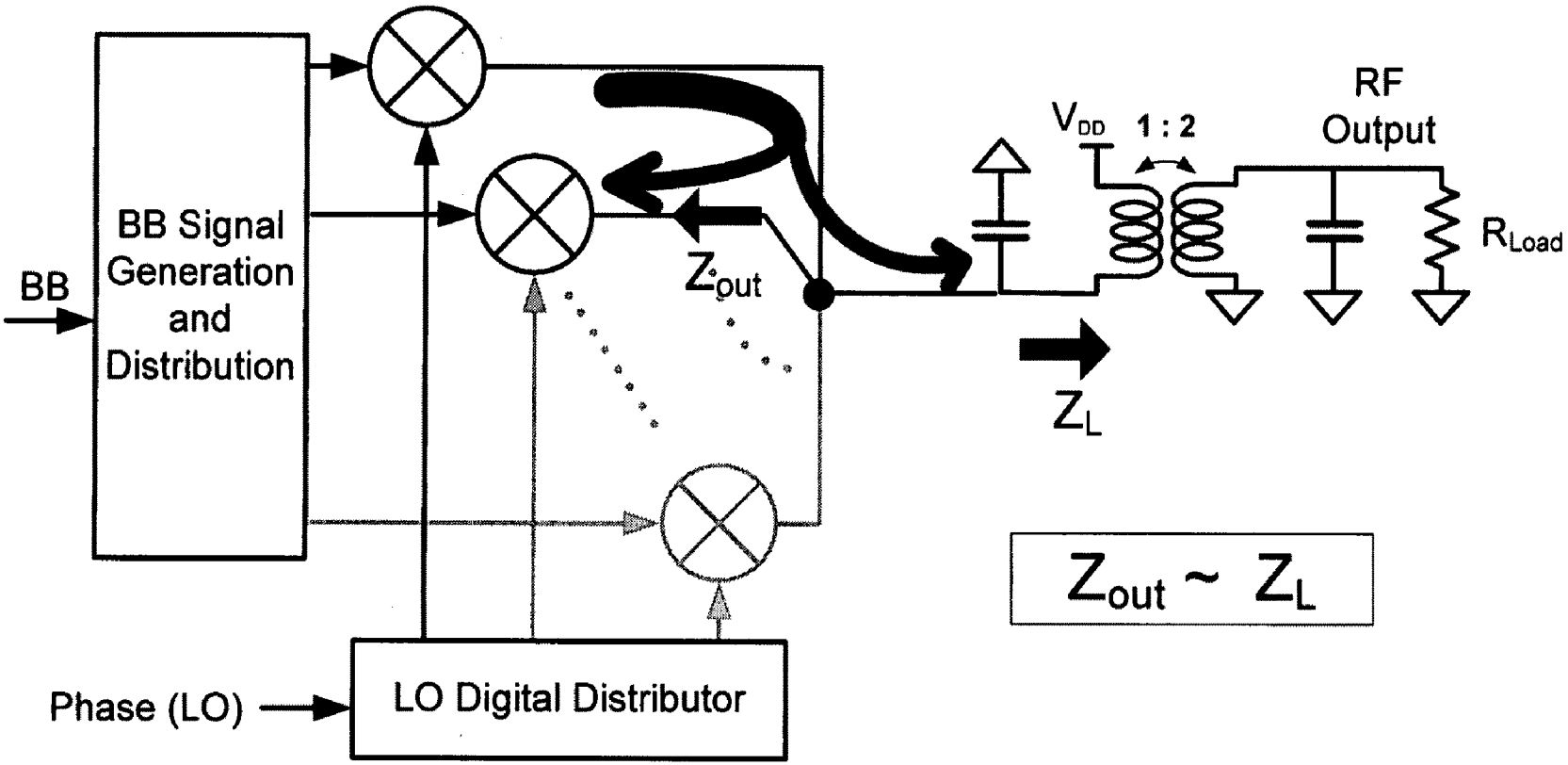
Figure 17:
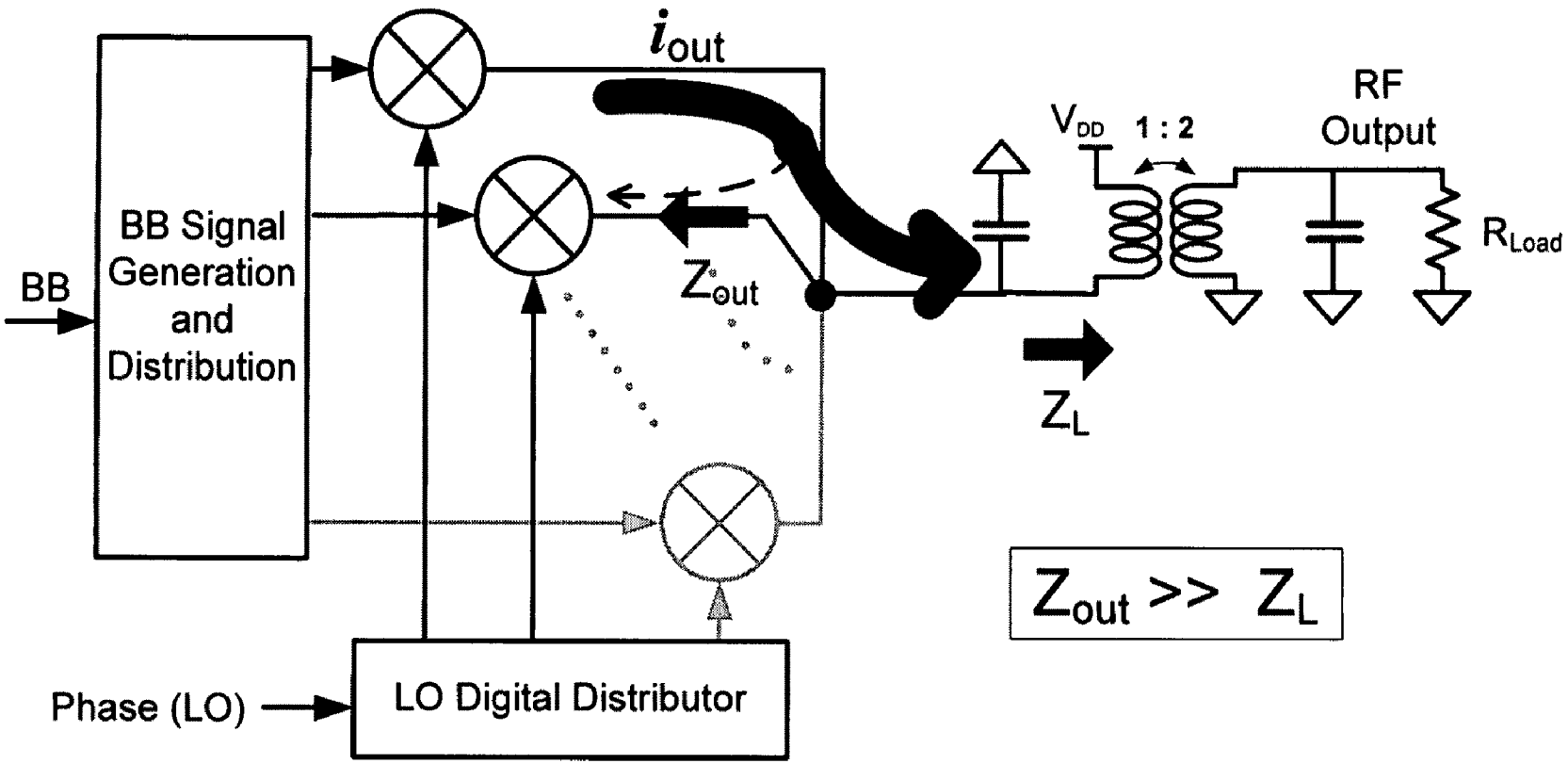

FIG. 15, FIG. 16 and FIG. 17 illustrate the output impedance of the power mixer, and the current flows that result, under varying conditions.

Figure 18:
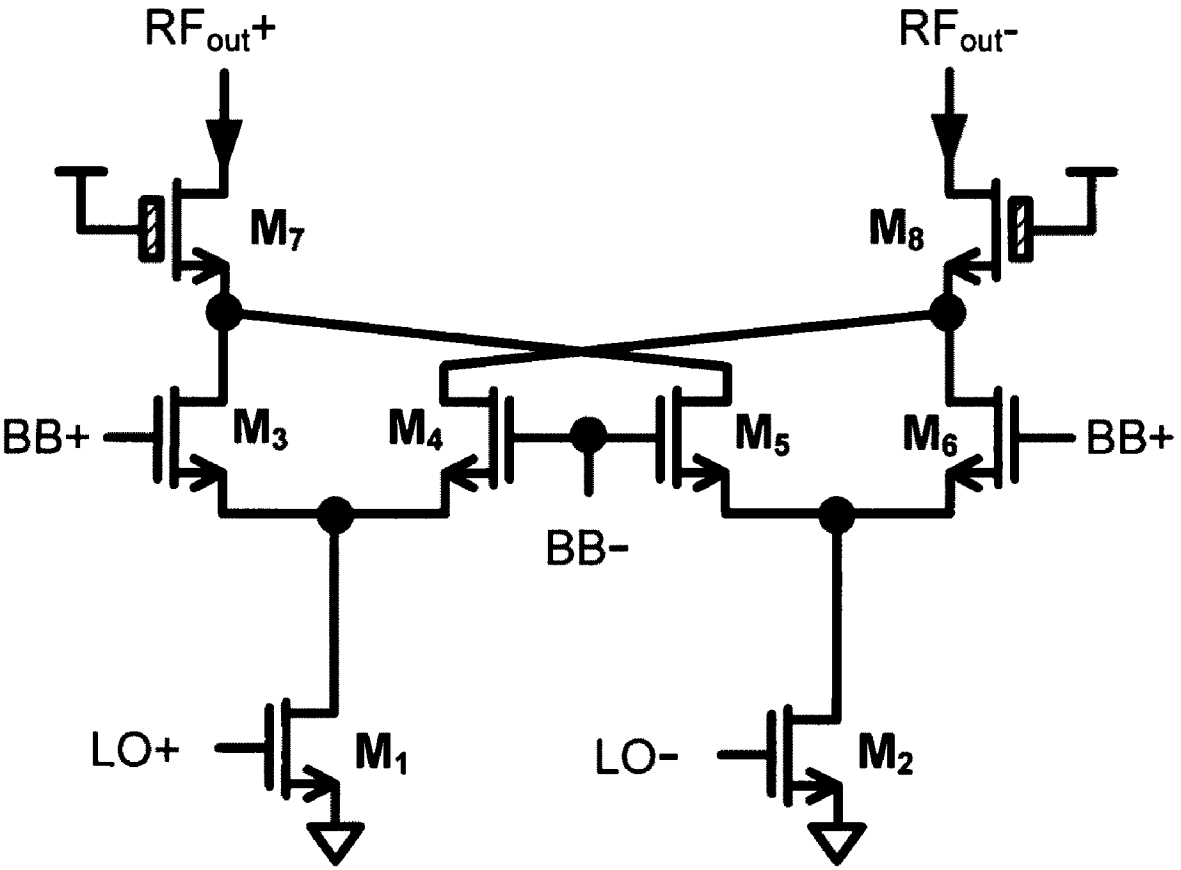
FIG. 18 is a circuit diagram of a current commuting power mixer.

FIG. 18 is a circuit diagram of a current commuting power mixer. This circuit configuration is useful to boost the voltage swing and to boost the output impedance. By using amplitude modulation, one can achieve "linear" modulation and a large bandwidth. By using switching operation, one can attain high efficiency and maintain low noise.

Figure 19:
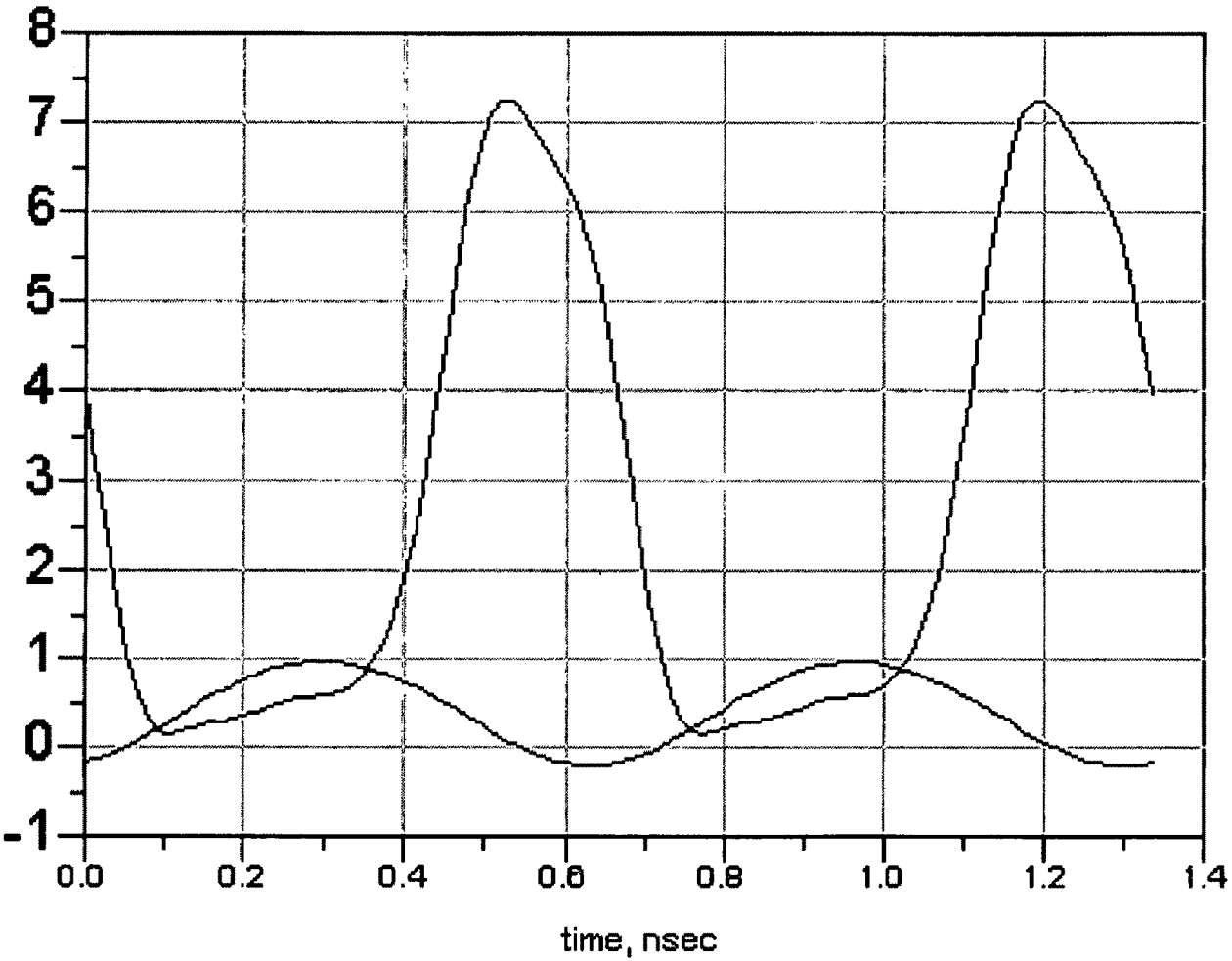
FIG. 19 is a diagram of the expected output and the input signal, based on an output load design by load pull simulation.

FIG. 19 is a diagram of the expected output and the input signal, based on an output load design by load pull simulation. In this design the expected peak efficiency is 60%, and the peak power=33 dBm.

Figure 20A:
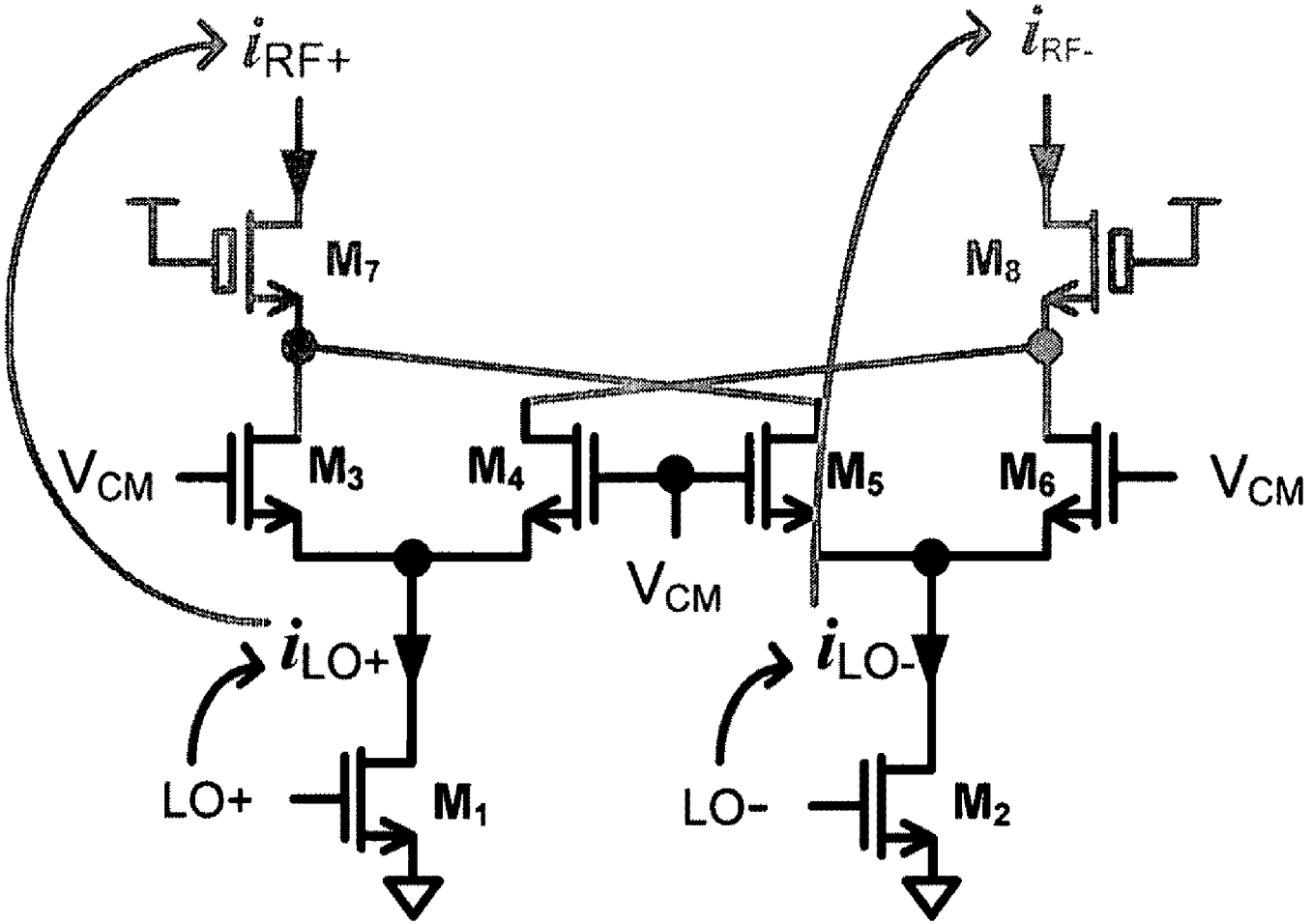
FIG. 20A is a diagram showing the various voltages and currents in the power amplifier.
Figure 20B:
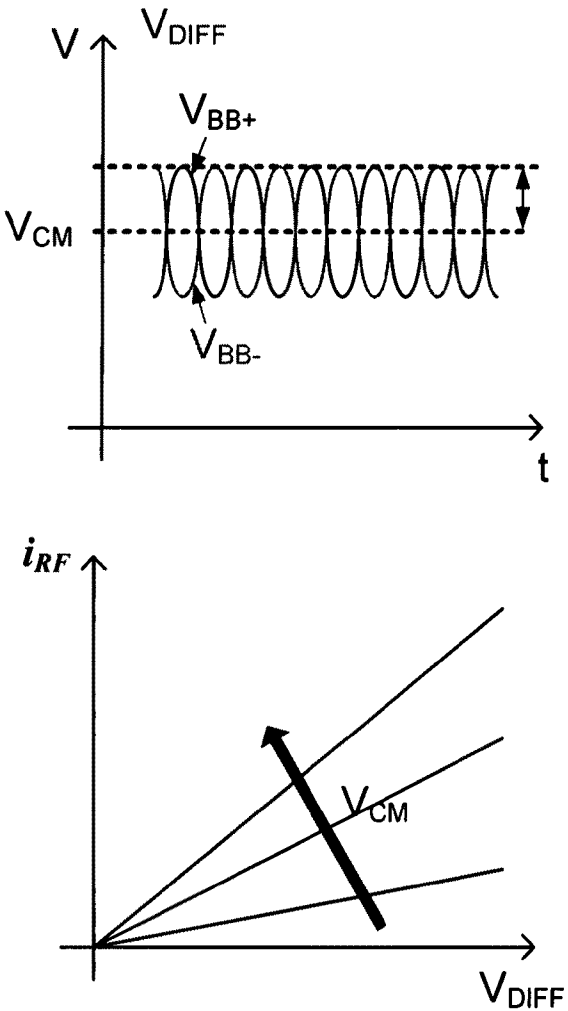
FIG. 20B is a diagram illustrating, in the upper panel, the relationship of the various voltages with time, and in the lower panel, the relationship between the differential voltage and the RF current as a function of the common mode voltage $V_{CM}$.

FIG. 20A is a diagram showing the various voltages and currents in the power amplifier. FIG. 20B is a diagram illustrating, in the upper panel, the relationship of the various voltages with time, and in the lower panel, the relationship between the differential voltage and the RF current as a function of the common mode voltage $V_{CM}$. The LO input voltage to $i_{LO}$ gain is proportional to the DC voltage of node X. The dependence of the DC voltage at node X on the $V_{CM}$ (or to the baseband inputs) is almost the same as a differential pair with a resistive current source. A change in Vx introduces amplitude modulation and phase modulation due to the limited slew rate as a consequence of capacitance. The gain is determined by 2 stages: the $I_{RF}$ is determined by the common-mode of the baseband input ($V_{CM}$), and the gain from $I_{LO}$ to $I_{RFout}$ is determined by the differential-mode of the baseband input ($V_{DIFF}$).

Figure 21:
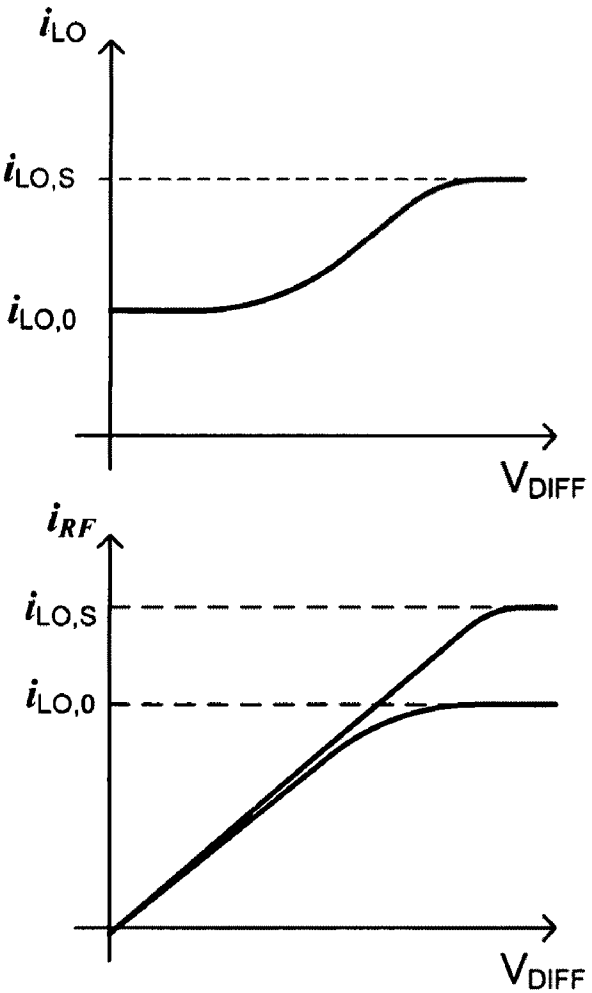
FIG. 21 is a diagram that illustrates the nonlinearity in $I_{LO}$ (upper panel) and $I_{RF}$ (lower panel), both as a function of $V_{DIFF}$.

FIG. 21 is a diagram that illustrates the nonlinearity in $I_{LO}$ (upper panel) and $I_{RF}$ (lower panel), both as a function of $V_{DIFF}$.

Figure 22A:
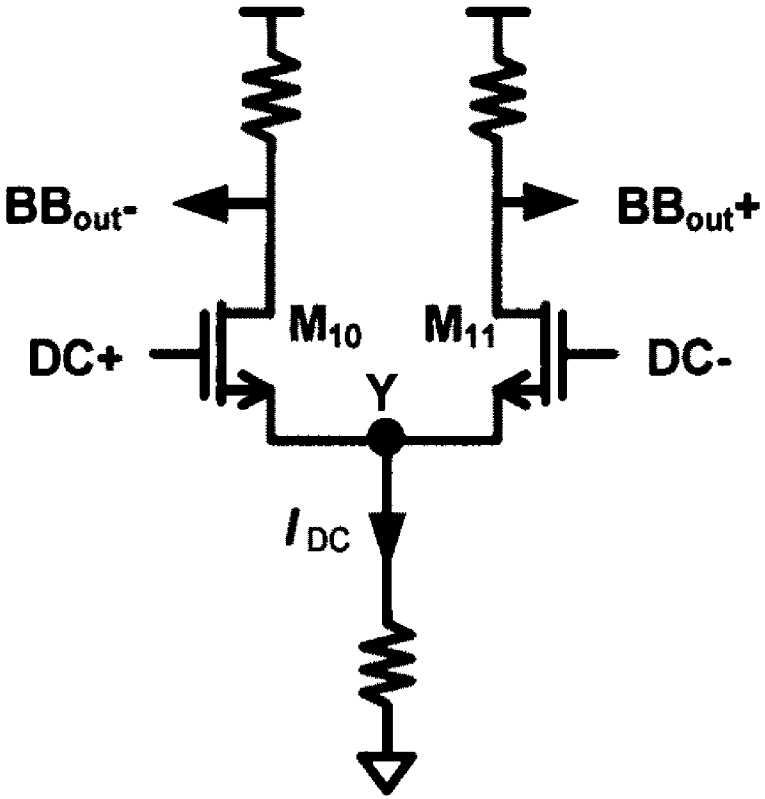
FIG. 22A is a diagram illustrating the DC approximation of the power mixer by a differential pair with resistive current source.

FIG. 22A is a diagram illustrating the DC approximation of the power mixer by a differential pair with resistive current source.

Figure 22B:
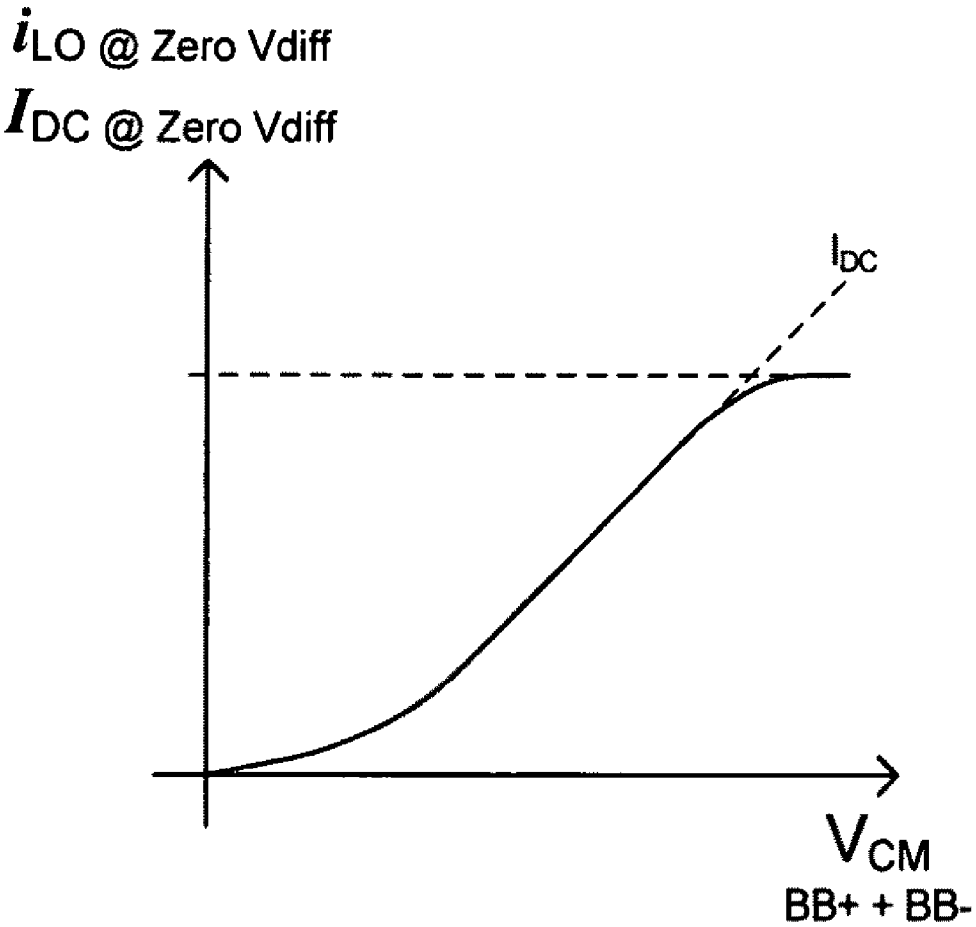
FIG. 22B is a diagram illustrating the behavior of $I_{LO}$ and $I_{DC}$ for zero $V_{DIFF}$ as a function of $V_{CM}$.

FIG. 22B is a diagram illustrating the behavior of $I_{LO}$ and $I_{DC}$ for zero $V_{DIFF}$ as a function of $V_{CM}$.

Figure 22C:
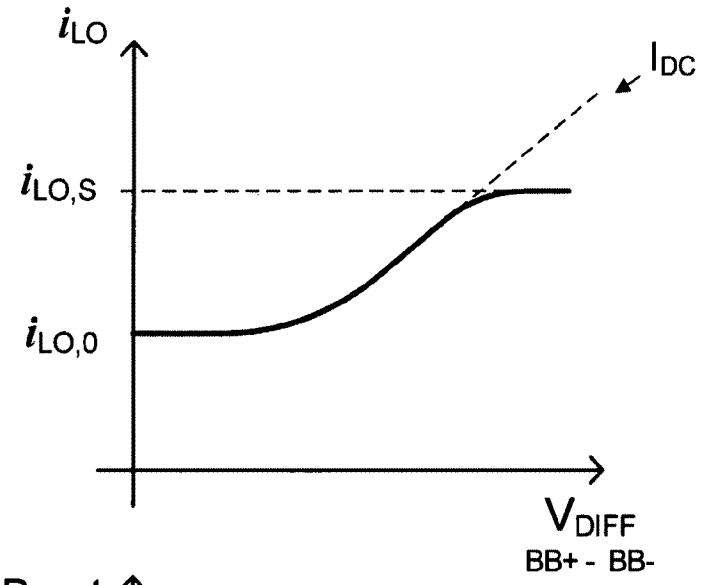
FIG. 22C is a diagram illustrating $I_{DC}$ as a function of $V_{DIFF}$.

FIG. 22C is a diagram illustrating $I_{DC}$ as a function Of $V_{DIFF}$.

Figure 22D:
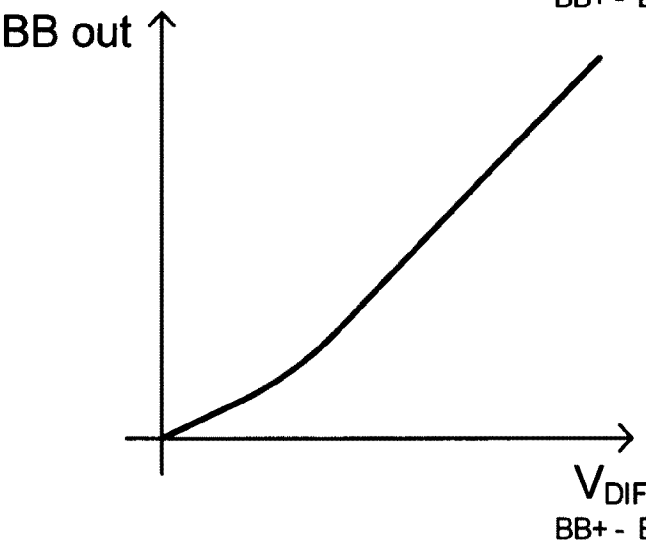
FIG. 22D is a diagram illustrating $BB_{OUT}$ as a function of $V_{DIFF}$.

FIG. 22D is a diagram illustrating $BB_{out}$ as a function of $V_{DIFF}$.

Figure 23:
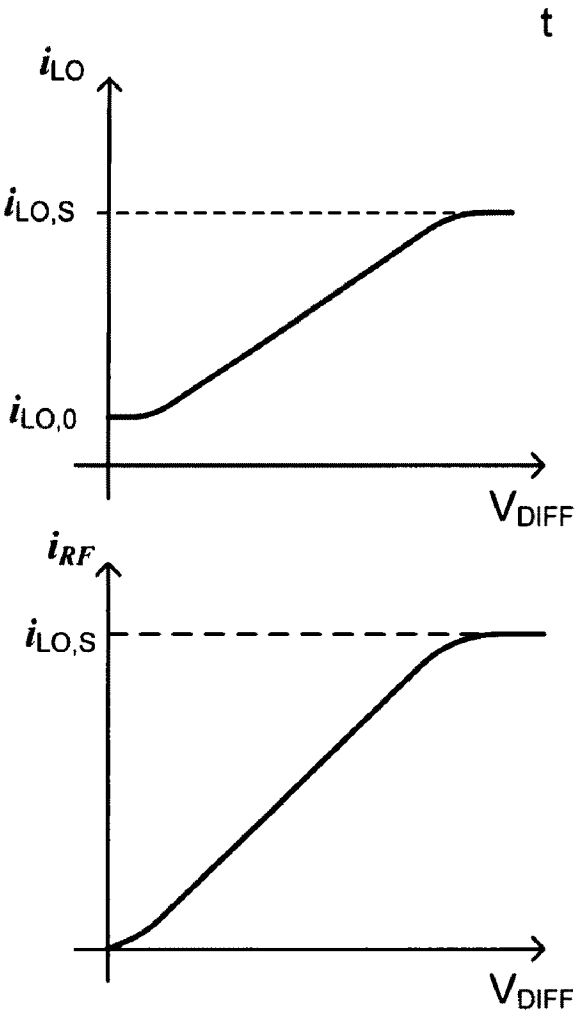
FIG. 23 is a diagram that illustrates the behavior of $V_{bb}$ with low common mode.

FIG. 23 is a diagram that illustrates the behavior of $V_{bb}$ with low common mode. The mixer automatically reduces the DC power when $V_{bb}$ is small. This is possible because the overall linearity of the array is insensitive to unit mixer linearity.

Turning to FIG. 2, one can understand how it is possible to obtain linearity improvement by feedback. One approach is to dynamically match the power mixer core and the baseband replica amplifier using feedback such that the power mixer core is matched to the replica differential amplifier. The replica amplifier can be a differential pair with a resistive current source, which represents the switching nature of M1 and M2 of the power mixer core. In one approach, the common mode of the $L_{BB+}$ and the $L_{BB-}$ signals can be fixed. In another approach, one can control the signals such that node Y of the replica amplifier follows the node X of the power mixer core as shown FIG. 2.

Figure 24:
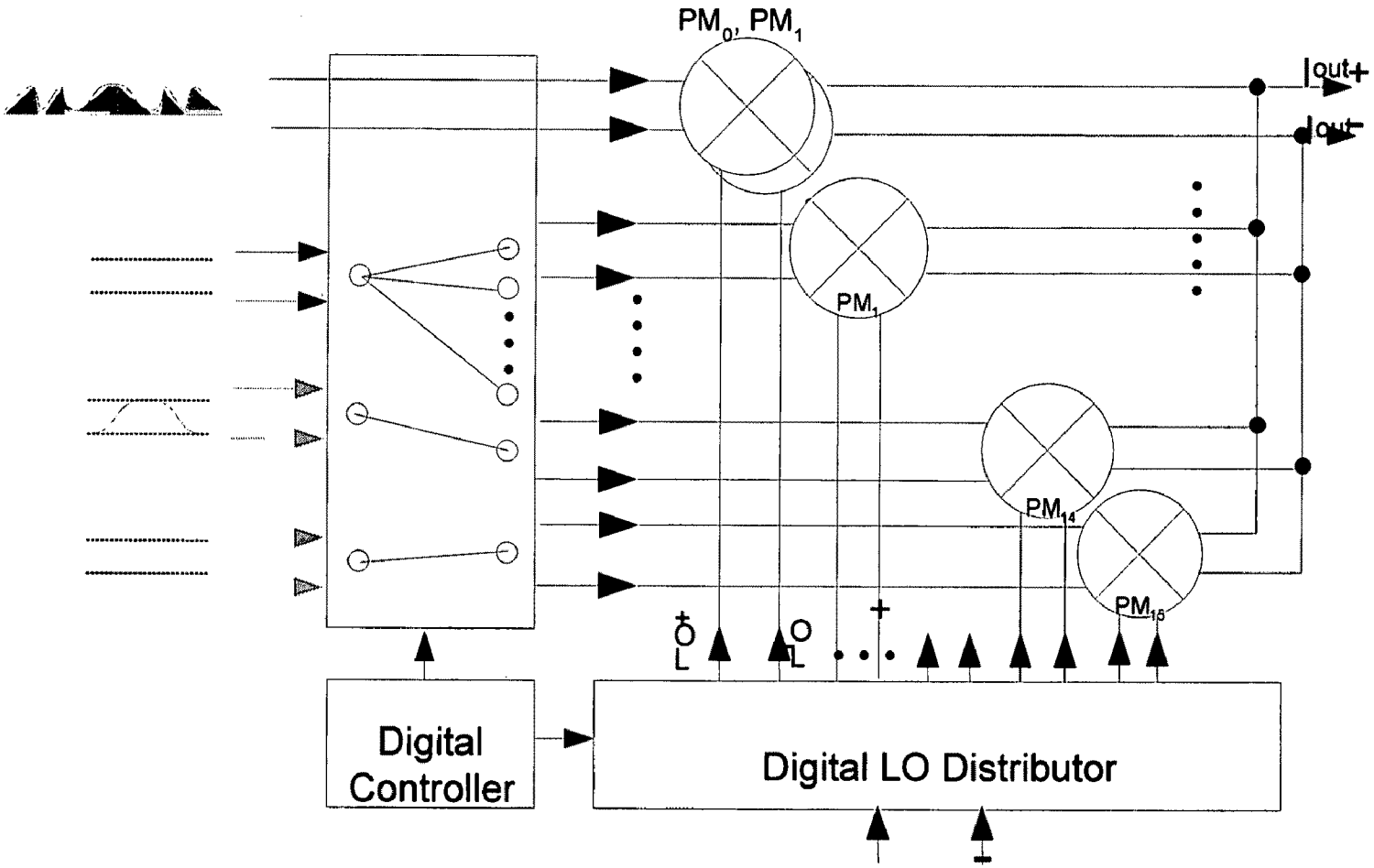
FIG. 24 is a schematic diagram illustrating the Segmented Efficiency(SE) Mode.

FIG. 24 is a schematic diagram illustrating the Segmented Efficiency(SE) Mode.

Figure 25B:
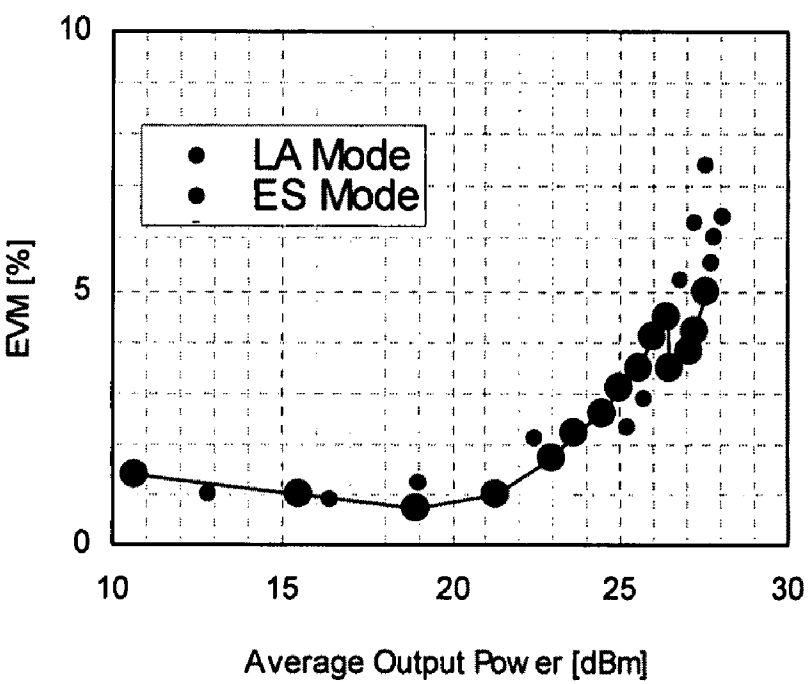
FIG. 25B is a diagram that shows the error vector magnitude (EVM) versus average output power for the Linearized Analog (LA) Mode and the Segmented Efficiency (SE) mode.
Figure 25A:
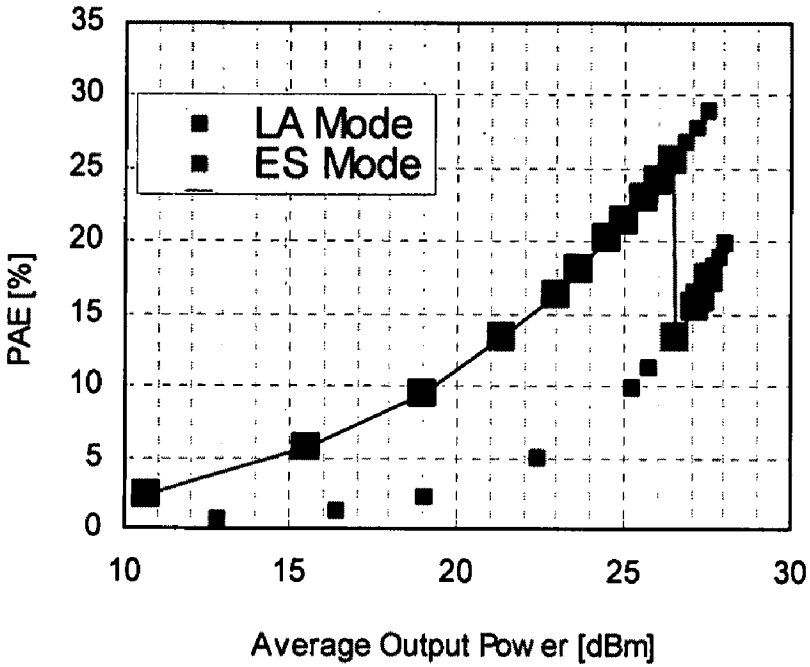
FIG. 25A is a diagram that shows the PAE versus average output power for the Linearized Analog (LA) Mode and the Segmented Efficiency (ES) mode.

FIG. 25A is a diagram that shows the PAE versus average output power for the Linearized Analog (LA) Mode and the Segmented Efficiency (ES) mode.

FIG. 25B is a diagram that shows the error vector magnitude (EVM) versus average output power for the Linearized Analog (LA) Mode and the Segmented Efficiency (ES) mode.

Figures 26A, 26B:
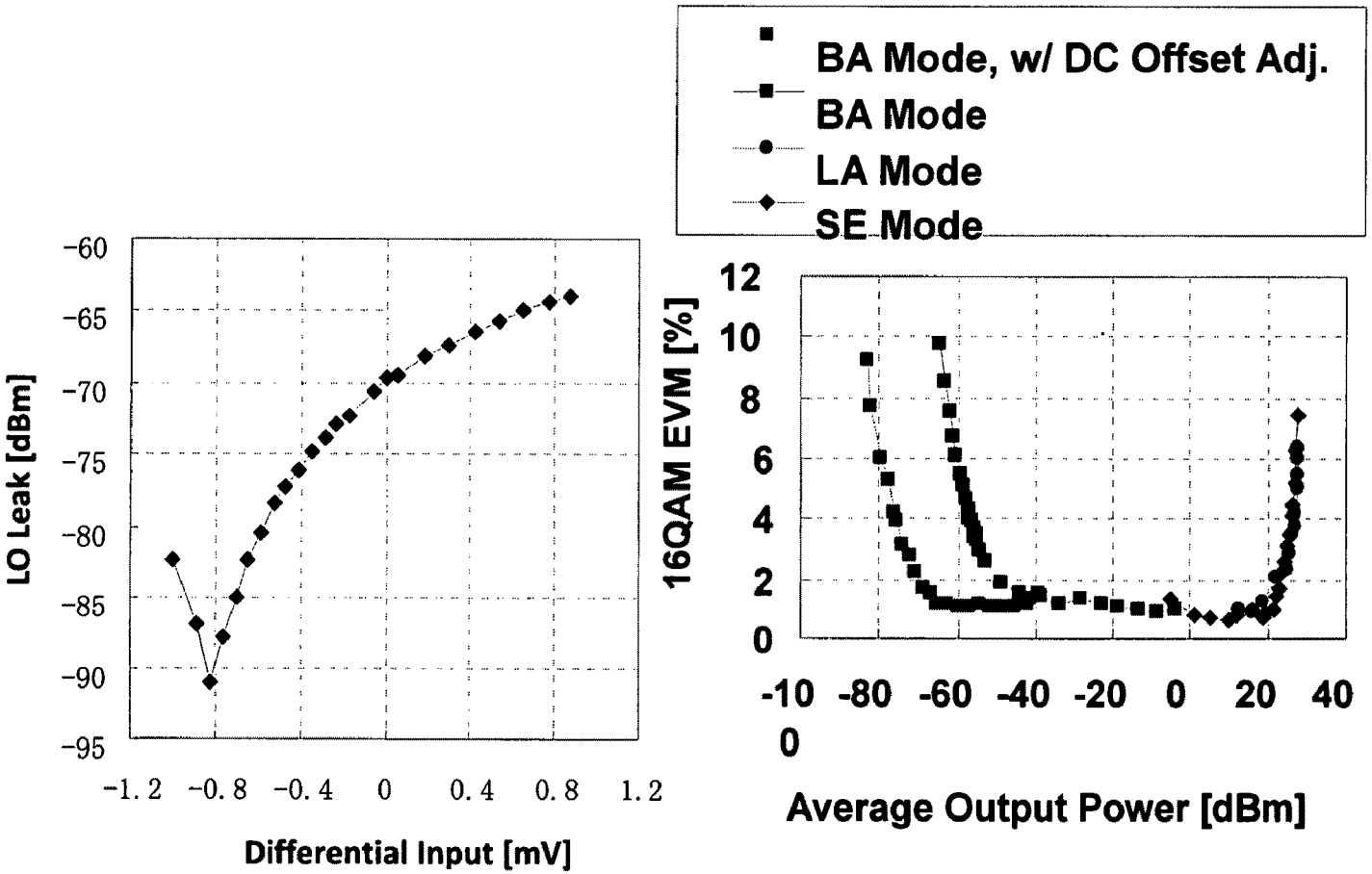
FIG. 26A is a diagram that shows the LO leak versus differential input for the Baseline Analog (BA) Mode.
FIG. 26B is a diagram that shows the 16-QAM EVM versus average output power for several operational modes.

FIG. 26A is a diagram that shows the LO leak versus differential input for the Baseline Analog (BA) Mode.

FIG. 26B is a diagram that shows the 16-QAM EVM versus average output power for several operational modes. The large output power range is attained using three methods of gain control, including: (1) common mode of BB input voltage of power mixer; (2) differential mode of BB input voltage of power mixer and (3) controlling the number of activated power mixer cores.

The digital controller in the power mixer array can be interfaced with and controlled using microprocessor based computer systems, such as are well known in the art.

General Purpose Programmable Computers

General purpose programmable computers useful for controlling instrumentation, recording signals and analyzing signals or data according to the present description can be any of a personal computer (PC), a microprocessor based computer, a portable computer, or other type of processing device. The general purpose programmable computer typically comprises a central processing unit, a storage or memory unit that can record and read information and programs using machine-readable storage media, a communication terminal such as a wired communication device or a wireless communication device, an output device such as a display terminal, and an input device such as a keyboard. The display terminal can be a touch screen display, in which case it can function as both a display device and an input device. Different and/or additional input devices can be present such as a pointing device, such as a mouse or a joystick, and different or additional output devices can be present such as an enunciator, for example a speaker, a second display, or a printer. The computer can run any one of a variety of operating systems, such as for example, any one of several versions of Windows, or of MacOS, or of Unix, or of Linux. Computational results obtained in the operation of the general purpose computer can be stored for later use, and/or can be displayed to a user. At the very least, each microprocessor-based general purpose computer has registers that store the results of each computational step within the microprocessor, which results are then commonly stored in cache memory for later use.

Machine-readable storage media that can be used in the invention include electronic, magnetic and/or optical storage media, such as magnetic floppy disks and hard disks; a DVD drive, a CD drive that in some embodiments can employ DVD disks, any of CD-ROM disks (i.e., read-only optical storage disks), CD-R disks (i.e., write-once, read-many optical storage disks), and CD-RW disks (i.e., rewriteable optical storage disks); and electronic storage media, such as RAM, ROM, EPROM, Compact Flash cards, PCMCIA cards, or alternatively SD or SDIO memory; and the electronic components (e.g., floppy disk drive, DVD drive, CD/CD-R/CD-RW drive, or Compact Flash/PCMCIA/SD adapter) that accommodate and read from and/or write to the storage media. As is known to those of skill in the machine-readable storage media arts, new media and formats for data storage are continually being devised, and any convenient, commercially available storage medium and corresponding read/write device that may become available in the future is likely to be appropriate for use, especially if it provides any of a greater storage capacity, a higher access speed, a smaller size, and a lower cost per bit of stored information. Well known older machine-readable media are also available for use under certain conditions, such as punched paper tape or cards, magnetic recording on tape or wire, optical or magnetic reading of printed characters (e.g., OCR and magnetically encoded symbols) and machine-readable symbols such as one and two dimensional bar codes.

Many functions of electrical and electronic apparatus can be implemented in hardware (for example, hard-wired logic), in software (for example, logic encoded in a program operating on a general purpose processor), and in firmware (for example, logic encoded in a non-volatile memory that is invoked for operation on a processor as required). The present invention contemplates the substitution of one implementation of hardware, firmware and software for another implementation of the equivalent functionality using a different one of hardware, firmware and software. To the extent that an implementation can be represented mathematically by a transfer function, that is, a specified response is generated at an output terminal for a specific excitation applied to an input terminal of a "black box" exhibiting the transfer function, any implementation of the transfer function, including any combination of hardware, firmware and software implementations of portions or segments of the transfer function, is contemplated herein.

Theoretical Discussion

Although the theoretical description given herein is thought to be correct, the operation of the devices described and claimed herein does not depend upon the accuracy or validity of the theoretical description. That is, later theoretical developments that may explain the observed results on a basis different from the theory presented herein will not detract from the inventions described herein.

Any patent, patent application, or publication identified in the specification is hereby incorporated by reference herein in its entirety. Any material, or portion thereof, that is said to be incorporated by reference herein, but which conflicts with existing definitions, statements, or other disclosure material explicitly set forth herein is only incorporated to the extent that no conflict arises between that incorporated material and the present disclosure material. In the event of a conflict, the conflict is to be resolved in favor of the present disclosure as the preferred disclosure.

While the present invention has been particularly shown and described with reference to the structure and methods disclosed herein and as illustrated in the drawings, it is not confined to the details set forth and this invention is intended to cover any modifications and changes as may come within the scope and spirit of the following claims.

What is claimed is:

1. A monolithic power mixer array, comprising:

a substrate having a surface;

a plurality of substantially similar power generation units adjacent said surface, each power generation unit having at least one signal input terminal, at least one baseband input terminal, and a signal output terminal;

a power combiner adjacent said surface, said power combiner having a plurality of input terminals sufficient in number to accept a power signal from each of said plurality of power generation unit signal output terminals and having an output terminal;

a baseband analog replica linearizer array adjacent said surface, said baseband analog replica linearizer array configured to receive an input baseband envelope signal and to generate at least one component signal configured as said input signal for at least one of said plurality of power generation units;

a baseband analog distributor adjacent said surface, said baseband analog distributor configured to receive at least one component signal configured as an input signal for at least one of said plurality of power generation units from said baseband analog replica linearizer array and configured to provide said component signal as said input signal to at least one of said plurality of power generation units and to receive a common mode signal from at least one of said power generation units for communication to the linearizer array; and a digital controller adjacent said surface, said digital controller configured to control the operation of each of said plurality of power generation units, and configured to control an input signal to said at least one signal input terminal of each of said plurality of power generation units;

said monolithic power mixer array configured to provide a power signal having a power level measured in units of watts.

2. The monolithic power mixer array of claim 1, wherein said digital controller configured to control the operation of each of said plurality of power generation units controls a local oscillator digital distributor configured to provide a local oscillator signal to each of said plurality of power generation units.

3. The monolithic power mixer array of claim 2, wherein said local oscillator digital distributor provides the same local oscillator signal to each of said plurality of power generation units.

4. The monolithic power mixer array of claim 1, further comprising an output transformer.

5. The monolithic power mixer array of claim 4, wherein said output transformer is configured to comprise a differential to single ended connection.

6. The monolithic power mixer array of claim 1, wherein said plurality of power generation units are operated according to a $2^N$-QAM modulation constellation.

7. The monolithic power mixer array of claim 6, wherein said digital controller is configured to operate less than all of said plurality of power generation units in response to a $2^N$-QAM symbol representative of a power level lower that the maximum power level of said power mixer array.

8. The monolithic power mixer array of claim 1, wherein said plurality of power generation units are operated according to a $\pi/4$-OQPSK modulation constellation.

9. The monolithic power mixer array of claim 1, wherein said digital controller is configured to operate said monolithic power mixer in a Segmented-Linear (SL) mode.

10. The monolithic power mixer array of claim 1, wherein said digital controller is configured to operate said monolithic power mixer in a Segmented-Efficiency (SE) mode.

11. The monolithic power mixer array of claim 1, wherein said digital controller is configured to operate said monolithic power mixer in a Linearized Analog (LA) mode.

12. A monolithic power mixer array, comprising:

a substrate having a surface;

a plurality of substantially similar power generation units adjacent said surface, each power generation unit having at least one signal input terminal, at least one baseband input terminal, and a signal output terminal;

a power combiner adjacent said surface, said power combiner having a plurality of input terminals sufficient in number to accept a power signal from each of said plurality of power generation unit signal output terminals and having an output terminal;

a baseband analog replica linearizer array adjacent said surface, said baseband analog replica linearizer array configured to receive an input baseband envelope signal and to generate at least one component signal configured as said input signal for at least one of said plurality of power generation units;

a baseband analog distributor adjacent said surface, said baseband analog distributor configured to receive at least one component signal configured as an input signal for at least one of said plurality of power generation units from said baseband analog replica linearizer array and configured to provide said component signal as said input signal to at least one of said plurality of power generation units and to receive a common mode signal from at least one of said power generation units for communication to the linearizer array; and a digital controller adjacent said surface, said digital controller electrically connected to said plurality of power generation units and configured to control the operation of each of said plurality of power generation units, and configured to control an input signal to said at least one signal input terminal of each of said plurality of power generation units;

said monolithic power mixer array configured to provide a power signal having a power level measured in units of watts.

* * * * *